US005557052A

United States Patent [19]

Hayashida et al.

[11] Patent Number: 5,557,052

[45] Date of Patent: Sep. 17, 1996

[54] KEYBOARD MUSICAL INSTRUMENT HAVING VARIABLE CONTACT POINT BETWEEN JACK AND REGULATION BUTTON

[75] Inventors: Hajime Hayashida; Satoshi Inoue, both of Shizuoka, Japan

[73] Assignee: Yamaha Corporation, Japan

[21] Appl. No.: 413,632

[22] Filed: Mar. 30, 1995

[30] Foreign Application Priority Data

Mar. 31, 1994 [JP] Japan ..... 6-083726
Jun. 3, 1994 [JP] Japan ..... 6-144139

[51] Int. Cl.[6] ..... G10C 3/18

[52] U.S. Cl. ..... 84/243; 84/221

[58] Field of Search ..... 84/241, 242, 243, 84/221, 247

[56] References Cited

U.S. PATENT DOCUMENTS

| | | | |
|---|---|---|---|
| 2,250,065 | 7/1941 | Koehl | 84/171 |
| 4,633,753 | 1/1987 | Takahashi | 84/220 |
| 4,704,931 | 11/1987 | Nagai et al. | 84/171 |
| 4,744,281 | 5/1988 | Isozaki | 84/171 |
| 4,970,929 | 11/1990 | Ishida | 84/220 |
| 5,115,705 | 5/1992 | Monte et al. | 84/617 |
| 5,247,129 | 9/1993 | Nozaki et al. | 84/615 |
| 5,374,775 | 12/1994 | Kawamura et al. | 84/615 |

FOREIGN PATENT DOCUMENTS

| | | |
|---|---|---|
| 68406 | 11/1890 | Germany . |
| 97885 | 10/1897 | Germany . |
| 44782 | 9/1898 | Germany . |
| 3707591 | 3/1987 | Germany . |
| 9-1U000077 | 3/1994 | Italy . |
| 51-67732 | 6/1976 | Japan . |
| 55-55880 | 4/1980 | Japan . |
| 62-32308 | 8/1987 | Japan . |
| 63-97997 | 4/1988 | Japan . |
| 4-174813 | 6/1992 | Japan . |
| 6-35445 | 2/1994 | Japan . |
| 6-59667 | 3/1994 | Japan . |
| 614303 | 2/1977 | Switzerland . |

*Primary Examiner*—Patrick J. Stanzione
*Attorney, Agent, or Firm*—Ostrolenk, Faber Gerb & Soffen, LLP

[57] ABSTRACT

A piano has a regulating button mechanism so as to cause a jack to escape from a hammer assembly, and the regulating button mechanism has a first regulating button and a second regulating button with which the jack is selectively brought into contact; and the jack imparts a force variable in dependence on the regulating button to the hammer assembly so as to generate loud or soft tones.

12 Claims, 15 Drawing Sheets

KEYBOARD MUSICAL INSTRUMENT HAVING VARIABLE CONTACT POINT BETWEEN JACK AND REGULATION BUTTON

FIELD OF THE INVENTION

This invention relates to a keyboard musical instrument and, more particularly, to a keyboard musical instrument having a variable contact point between a jack and a regulating button depending upon a mode of operation.

DESCRIPTION OF THE RELATED ART

A piano is a typical example of the keyboard musical instrument. The piano generates a loud sound through an impact of a hammer on a set of strings, and the player is afraid that the loud sounds disturb the neighborhood. For this reason, a piano is equipped with a muting/silent mechanism for muting the loudness of the sounds.

A prior art muting mechanism is constituted by a cushion member and a driving mechanism, and the driving mechanism moves the cushion member onto the strings. While a player is performing a music, the hammer assemblies rebound on the cushion member, and softly strike the sets of strings. The cushion member rapidly takes up the vibrations of the strings, and the strings generate soft sounds.

U.S. Pat. No. 2,250,065 discloses a prior art silent mechanism, and the disclosed silent mechanism picks up the hammer assemblies so as to cut off the functional relation between the key action mechanisms and the hammer assemblies. Even if a player depresses the keys, the depressed keys actuate only the associated key action mechanisms: however, the key action mechanisms do not drive the hammer assemblies for rotation. Thus, the strings are not struck by the hammer assemblies, and a sound is not generated by the piano. If key sensors and/or hammer sensors are provided for the piano equipped with the silent mechanism, a tone generator may generate electronic sounds on the basis of the detected key/hammer motions.

The prior art muting mechanism can not perfectly eliminate the sounds from the piano, and the prior art silent mechanism changes the key-touch unique to the acoustic piano, because an escape of the jack from the hammer roller gives the unique key-touch to the player. Namely, while a player is depressing a key, the jack is escaped from the hammer roller, and player's finger suddenly feels light due to the elimination of the hammer weight.

Japanese Patent Application No. 4-174813 proposed a silent mechanism for an acoustic piano, and U.S. Ser. No. 08/073,092 was filed claiming the priority right on the basis of Japanese Patent Application No. 4-174813 together with other Japanese Patent Applications. Although several prior arts opposed against U.S. Ser. No. 08/073,092, the U.S. Patent Application was patented, and U.S. Pat. No. 5,374,775 was issued on Dec. 20, 1994. The references cited in the patent prosecution are U.S. Patent documents U.S. Pat. Nos. 2,250,065, 4,633,753, 4,704,931 , 4,744,281, 4,970,929, 5,115,705 and 5,247,129 and Foreign Patent documents 44782 (Germany), 68406 (Germany), 97885 (Germany), 3707591 (Germany) and 3707591C1 (Germany), To9-1U000077 (Italy), 51-67732 (Japan), 55-55880 (Japan), 62-32308 (Japan), 63-97997 (Japan) and 614303 (Switzerland).

The silent mechanism disclosed in U.S. Pat. No. 5,374,775 moves a stopper into and out of the paths of the hammer shanks, and the hammer shank rebounds on the stopper staying in the paths of the hammer shanks before an impact on the strings.

However, the silent mechanism disclosed in U.S. Pat. No. 5,374,775 requires a wide space between the strings and the hammer heads in the home position, and is hardly installed in a small-sized piano and some kind of piano with a narrow space between the hammers and the strings. In detail, when deformation of a hammer shank and the stopper is taken into account, the silent mechanism requires a gap ranging from 5 to 10 millimeters between the hammer heads and the strings at the reboud of the hammer shanks on the stopper so as to prevent the strings from the hammer heads. On the other hand, although the escape point is variable depending upon the notes assigned the strings, the escape point of a kind of piano is regulated to 3 millimeters for low-pitched tones, 2.5 millimeters for middle-pitched tones and 2 millimeters for high-pitched tones. If the silent mechanism is effective, the hammer shanks are brought into contact with the stopper before the escape of the jacks from the hammer rollers, and are caught between the stopper and the jacks.

Japanese Patent Application No. 4-215400 discloses a regulating mechanism for changing the escape point, and U.S. Ser. No. 08/174,179 and European Patent Application No. 93120645.2 were filed claiming the priority rights on the basis of Japanese Patent Application No. 4-215400 together with other Japanese Patent Applications. The regulating mechanism disclosed in Japanese Patent Application No. 4-215400 has a spacer insertable into a gap between the toe of the jack and the regulating button, and the spacer allows the jack to escape from the hammer butt (or the hammer roller) earlier than the escap after the direct contact between the jack and regulating button.

However, the jack early escaping from the hammer butt or the hammer roller causes the player to feed the key-touch shallow. The shallow key-touch may not be serious to a beginner. However, professional pianists hate the shallow key-touch.

SUMMARY OF THE INVENTION

It is therefore an important object of the present invention to provide a keyboard musical instrument which is equipped with a mechanism increasing a gap between a hammer head and strings at a finish of an escape without change of a starting point of the escape for a key-touch unique to a piano.

To accomplish the object, the present invention proposes to change a contact point between a short portion of a jack and a regulating button mechanism.

In accordance with the present invention, there is provided a keyboard musical instrument comprising: a plurality of keys respectively assigned notes of a scale, and selectively moved by a player; a plurality of string means associated with the plurality of keys for generating acoustic tones having the notes, respectively; a plurality of hammer assemblies respectively associated with the plurality of string means for striking the associated string means when the player selectively depresses the plurality of keys, a plurality of key action mechanisms functionally connected between the plurality of keys and the plurality of hammer assemblies, respectively, and each including a whippen assembly rotated by the associated key moved by the player, a regulating button mechanism, and a jack having a long portion and a short portion merged with the long portion at an intermediate portion rotatably supported by the whippen assembly and brought into contact with the regulating button mechanism for escaping from the associated hammer assembly; and a change-over means associated with the regulating button mechanism for changing a contact point between the short portion and the regulating button mechanism.

The keyboard musical instrument may further comprise a stopper for preventing the plurality of string means from impacts of the hammer assemblies and an electronic sound generating system for generating electronic sounds in response to the keys depressed by the player.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
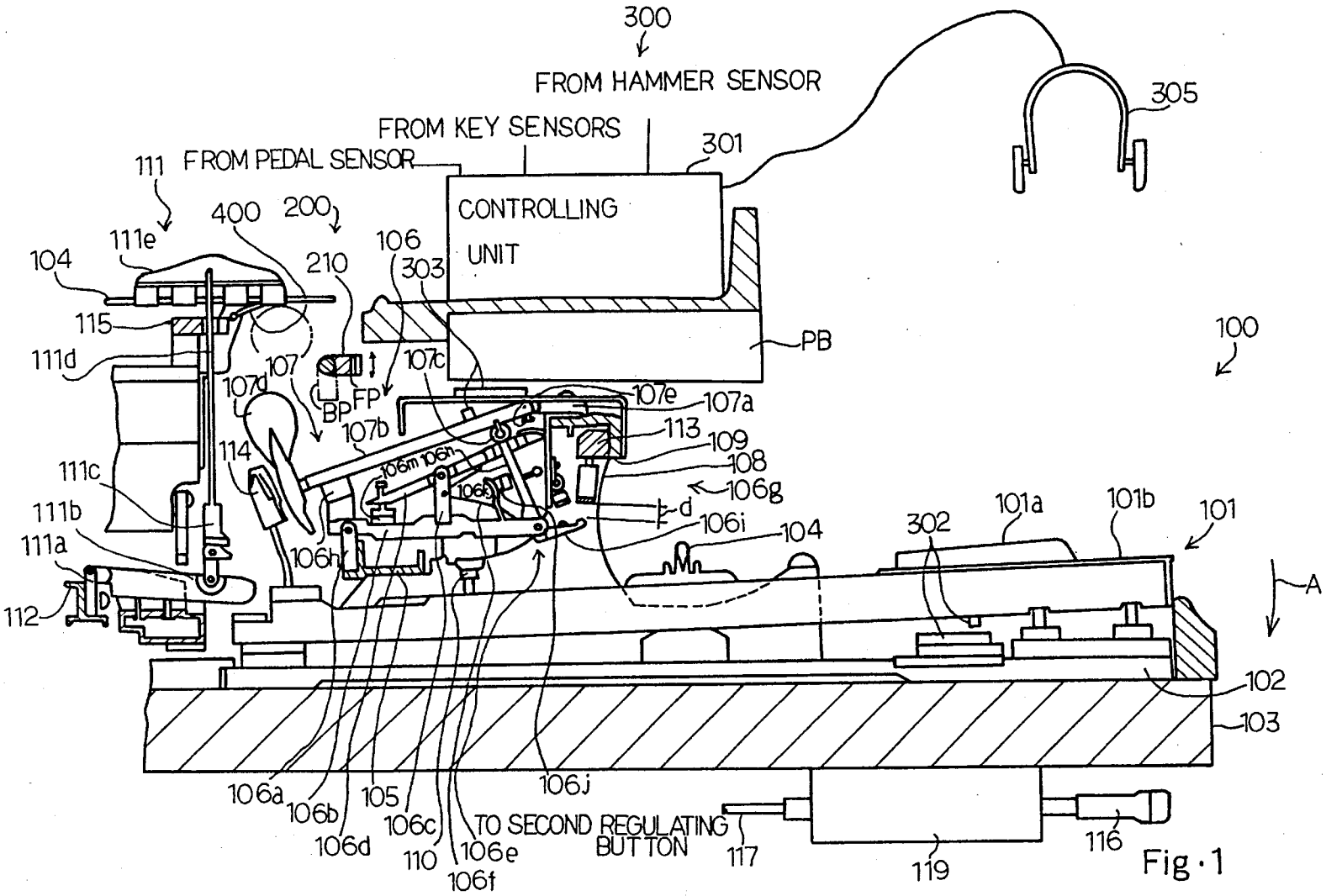
FIG. 1 is a cross sectional view showing the structure of a keyboard musical instrument according to the present invention.

Referring first to FIG. 1 of the drawings, a keyboard musical instrument embodying the present invention largely comprises a grand piano 100, a silent system 200 and an electronic sound generating system 300, and selectively enters into at least a standard acoustic sound mode, a muting mode and a silent mode. The grand piano is a standard type, and a piano case (not shown) houses most of internal mechanisms of the grand piano 100. In the following description, a rotational direction is determined in a figure to be referenced, and a player sits on the front side of the keyboard musical instrument during a performance.

The grand piano 100 comprises a keyboard 101 supported by a key frame 102 mounted on a key bed 103. Eighty-eight black and white keys 101*a* and 101*b* form the keyboard 101, and are turnable with respect to balance pins 104. The black and white keys 101*a* and 101*b* extend in a fore-and-aft direction of the grand piano, and front end portions of the black and white keys 101*a* and 101*b* are exposed to a player. While a force is not being exerted by the player, the black and white keys 101*a* and 101*b* are staying in respective rest positions as shown in FIG. 1. When the player depresses the black and white keys 101*a* and 101*b*, the black and white keys 101*a* and 101*b* are moved as indicated by arrow A, and arrive at respective end positions. Notes of a scale are respectively assigned to the black and white keys 101*a* and 101*b*, respectively.

The grand piano 101 further comprises a plurality of sets of strings 104 horizontally stretched between tuning pins (not shown) and hitch pins (not shown) over the keyboard 101, a whippen rail 105 laterally extending over the rear end portions of the black and white keys 101*a* and 101*b*, a plurality of key action mechanisms 106 supported by the whippen rail 105 and a plurality of hammer assemblies 107 turnably supported by a hammer shank rail 109. Action brackets support the whippen rail 105 and the shank flange rail 109. The action brackets 108, the black and white keys 101*a*/101*b* and the key frame 102 are laterally movable by means of a shift pedal (not shown), and cause the hammer assemblies 107 to strike the strings fewer than the normal number for lessening the softening the timbre and prolonging the tones. The sets of strings 104 respectively vibrate, and generate acoustic tones with the notes of the scale assigned to the black and white keys 101*a* and 101*b*, respectively.

The plurality of key action mechanisms 106 are similar in structure to one another, and are functionally connected to the black and white keys 101*a* and 101*b* by means of capstan screws 110. When the black and white keys 101*a* and 101*b* are depressed, the associated key action mechanisms 106 are actuated by the capstan screws 110, and rotate the associated hammer assemblies 107 toward the sets of strings 104. The hammer assemblies 107 rebound on the sets of strings 104, and return to respective home positions shown in FIG. 1.

The grand piano 100 further comprises a plurality of damper mechanisms 111 movably supported by a damper lever rail 112. The damper mechanisms 111 are respectively held in contact with the sets of strings 104 while the black and white keys 101*a* and 101*b* are staying in the rest positions, and do not allow the strings 104 to vibrate. The damper mechanisms 111 is respectively actuated by the rear end portions of the black and white keys 101*a* and 101*b*, and are separated from the sets of strings 104. Then, the strings 104 are allowed to vibrate, and generate the acoustic tones, respectively.

Each of the key action mechanisms 106 comprises a whippen flange 106*a* fixed to the whippen rail 105, an whippen assembly 106*b* turnably supported by the whippen flange 106*a*, a repetition lever flange 106*c* fixed to an intermediate portion of the whippen assembly 106*b*, a repetition lever 106*d* turnably supported by the repetition lever flange 106*c*, a jack 106*e* turnably supported by a front end portion of the whippen assembly 106*b*, a repetition spring 106*f* urging the repetition lever 106*d* and the jack 106*e* in the counter clockwise direction and a regulating button mechanism 106*g* supported by the hammer shank rail 109.

The hammer assemblies 107 are also similar to one another, and each hammer assembly 107 comprises a hammer shank flange 107*a* fixed to the hammer shank rail 109, a hammer shank 107*b* turnably connected to the hammer shank flange 107*b*, a hammer roller 107*c* fixed to the hammer shank 107*b* and a hammer head 107*d* fixed to the leading end of the hammer shank 107*b*.

The jack 106*e* has an L-shape, and is broken down into a long portion 106*h* and a short portion 106*i*. The long portion 106*h* passes through an aperture formed in the repetition lever 106*d*, and the hammer assembly 107 at the home position causes the hammer roller 107*c* to stay on the top surface of the long portion 106*h* of the jack 106*e*. On the other hand, the short portion 106*i* is opposed to the regulating button mechanism 106*g* while the black/white key 101*a*/101*b* is resting. The repetition spring 106*f* urges the jack 106*e* in the counter clockwise direction at all times, and a jack button 106*j* backwardly projects from the long portion 106*h* is pressed against a jack stop spoon 106*k* fixed to the whippen assembly 106*b* while the short portion 106*i* is spaced from the regulating button mechanism 106*g*.

The repetition lever 106*d* is urged in the counter clockwise direction at all times, and a repetition lever button 106*m* is pressed against the rear end portion of the whippen assembly 106*b*.

While the hammer assembly 107 is staying at the home position, the hammer roller 107*c* rests on a top surface of the long portion 106*h* of the jack 106*e*, and the hammer shank stop felt 106*n* is fixed to the rear end portion of the whippen assembly 106*b*. A drop screw 107*e* downwardly projects from the hammer shank flange 107*a*, and regulates the amount of return distance from the closest point when a player softly depressing the associated key.

Figure 2:
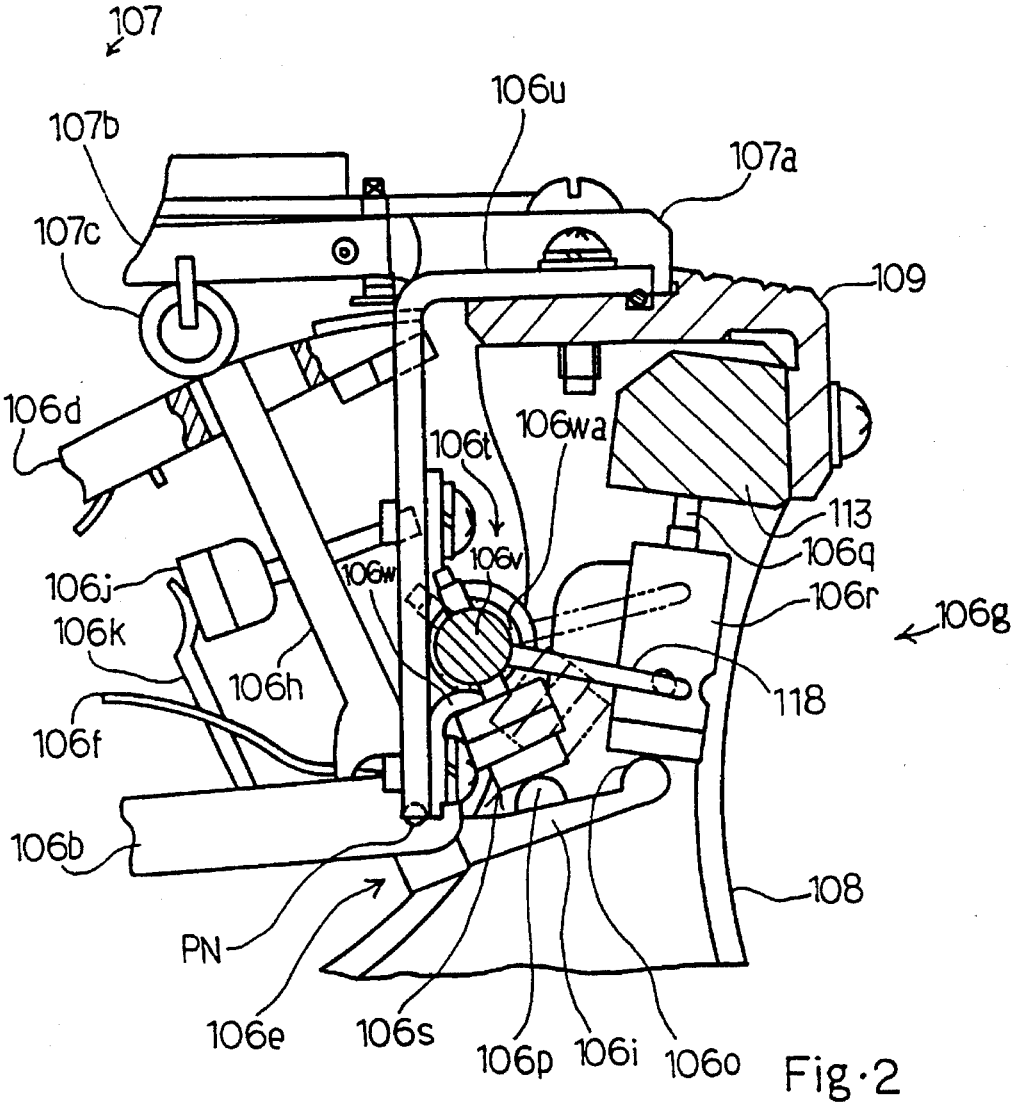
FIG. 2 is a side view showing a regulating button mechanism incorporated in the keyboard musical instrument at a starting point of an escape according to the present invention.
Figure 3:
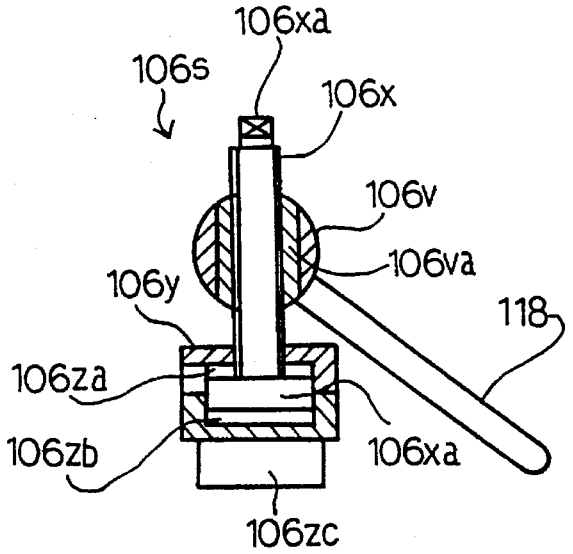
FIG. 3 is a cross sectional view showing a second regulating button incorporated in the regulating button mechanism.

As will be better seen in FIGS. 2 and 3 of the drawings, first and second semi-spherical portions 106*o* and 106*p* are formed on the short portion 106*i* of the jack 106*e*, and the first semi-spherical portion 106*o* is usually called as "toe".

The regulating button mechanism 106*g* associated with each jack 106*e* comprises a first regulating screw 106*q* inserted into a first regulating rail 113 screwed into the hammer shank rail 109, a first regulating button 106*r* fixed to the first regulating screw 106*q*, a second regulating button 106*s* engageable with the second semi-spherical portion 106*p* and a change-over sub-mechanism 106*t* shared with other second regulating buttons 106*s*. In this instance, the distance between the rotational axis of the jack 106*e* and the first semi-spherical portion 106*o* is twice as long as the distance between the rotational axis of the jack 106*e* and the second semi-spherical portion 106*p*.

Assuming now that the key 101*a*/101*b* is depressed at a certain speed, the jack 106*e* brought into contact with the second regulating button 106*s* at the second semi-spherical portion 106*p* gives a smaller force to the hammer assembly 107 than the jack 106*e* brought into contact with the regulating button 106*r* at the first semi-spherical portion 106*o*. Moreover, the transmitting time period of the former is shorter than the transmitting time period of the latter. As a result, the hammer assembly 107 associated with the former slowly turns around the shank flange 107*a*, and gently rebounds on the strings for producing a soft acoustic tone.

However, the starting point of escape is not changed between the first regulating button 106*r* and the second regulating button 106*s*, and the key-touch unique to the grand piano is given to the player in all of the modes of operation.

Figure 4:
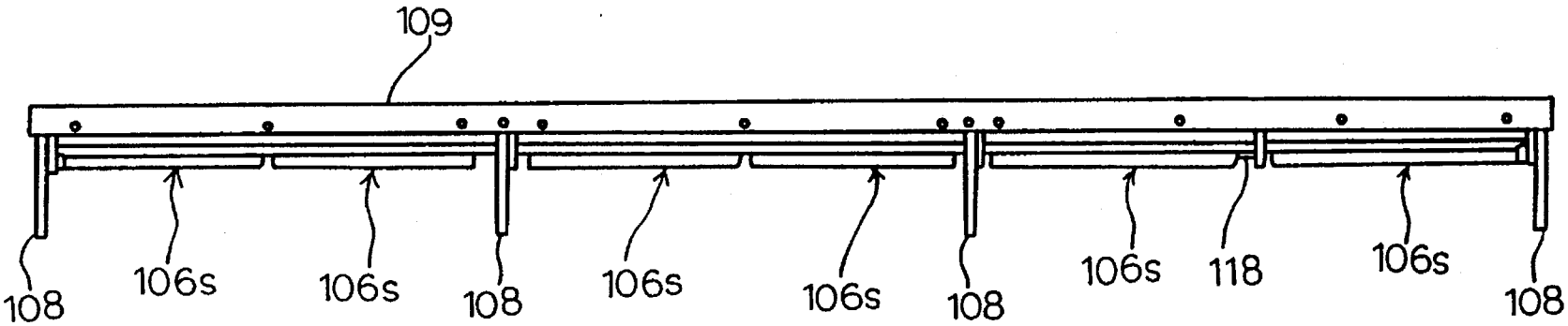
FIG. 4 is a front view showing second regulating buttons incorporated in the keyboard musical instrument.
Figure 5:
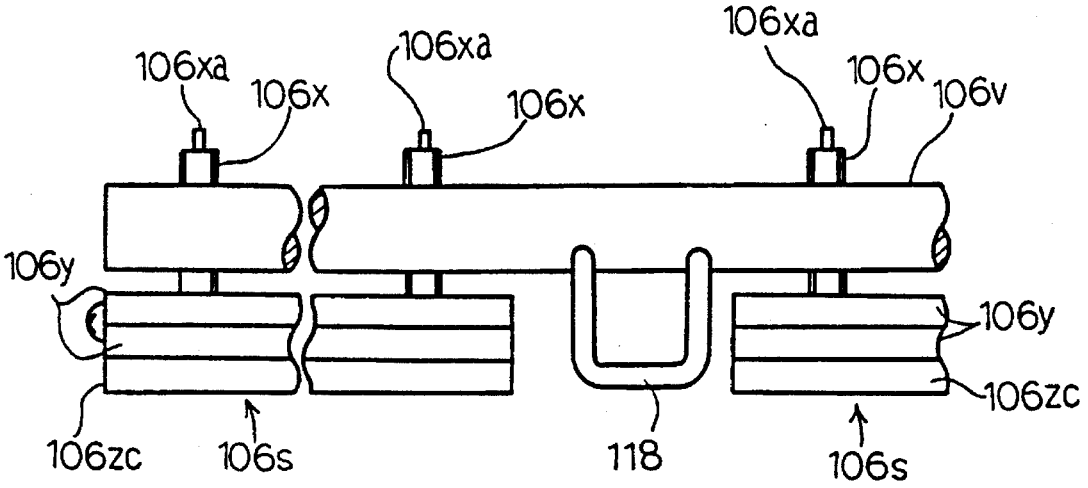
FIG. 5 is a front view showing a part of the second regulating buttons.

As will be better seen from FIGS. 4 and 5, each of the second regulating buttons 106*s* is associated with one of the plurality of groups of key action mechanisms 106, and, accordingly, the key action mechanisms 106 of each group share the second regulating buttons 106*s*.

The change-over sub-mechanism 106*t* comprises a second regulating rail bracket 106*u* bolted to the hammer shank rail 109 and a rod member 106*v* rotatably supported by means of bearing units 106*w* on the second regulating rail bracket 106*u*, and the second regulating buttons 106*s* are split into a plurality of sections respectively corresponding to the groups of the key action mechanisms 106. Cloth members 106*wa* are inserted between the inner surfaces of the bearing units 106*w* and the rod member 106*v*, and allow the rod member 106*v* to be smoothly rotated.

Each second regulating button 106*s* comprises a threaded stem portion 106*x* screwed into each of bush members 106*va* inserted into through holes formed in the rod member 106*v* at intervals, a bracket 106*y* fixed to the leading end of the threaded stem portion 106*x*, cloth punchings 106*za* and 106*zb* inserted between the bracket 106*y* and the head portion of the threaded stem portion 106*x* and a cloth member 106*zc* attached to the lower surface of the bracket 106*y*. The bracket 106*y* is split into two peaces, and the threaded stem portion 106*x* is rotatable in the bracket 106*y*. A cubic head 106*xa* is formed at the opposite end of the threaded stem portion 106*x*, and a tuner can rotate the threaded stem portion 106*x* with a wrench. Therefore, the gap between the second semi-spherical portion 106*p* and the cloth member 106*zc* is regulatable by turning the threaded stem portion 106*x*. The rod member 106*v* is shared between all of the second regulating buttons 106*s*, and a manipulating grip 116 is connected through a flexible wire 117 to connecting rods 118 implanted into the rod member 106*v*. The manipulating grip 116 is slidable in a case 119 attached to the key bed 103.

Though not shown in the drawings, a spring urges the connecting rods 118 in the counter clockwise direction, and the second regulating buttons 106*s* are changed to an idling position indicated by dots-and-dash line in FIG. 2. While the keyboard musical instrument is being performed in the standard acoustic sound mode, the spring maintains the second regulating buttons 106*s* in the idling position. On the other hand, when the keyboard musical instrument enters into the muting mode or the silent mode, the manipulating grip 116 is pulled toward the front side, and the connecting rods 118 rotate the rod member 106*v* in the clockwise direction against the elastic force of the spring (not shown). Then, the second regulating buttons 106*s* is changed to an active position, and the cloth members 106*zc* are opposed to the second semi-spherical portions 106*p*.

The regulating rail 113 is split into a plurality of regulating rail sections, and the regulating rail sections are corresponding to a plurality of groups of action mechanisms. The first regulating button 106*r* is opposed to the first semi-spherical portion 106*o*, and the gap d between the first semi-spherical portion 106*o* and the first regulating button 106*r* is regulatable by turning the first regulating button 106*r*. A starting point of escape of the jack 106*e* is determined by the gap d, and is usually regulated in such a manner that the hammer head 107*d* reaches 2–3 millimeters from the associated set of strings 104. If the gap d is decreased, the starting point of escape becomes early. On the other hand, if the gap d is increased, the starting point of escape becomes late.

Turning back to FIG. 1, while a black/white key 101*a*/101*b* is traveling from the rest position to the end position, the capstan button 110 upwardly pushes the whippen assembly 106*b*, and the whippen assembly 106*b* and the jack 106*e* turn around the whippen flange 106*a* in the counter clockwise direction. The jack 106*e* turning around the whippen flange 106*a* causes the hammer assembly 106*d* to turn around the shank flange 107*a* in the clockwise direction. When one of the first and second semi-spherical portions 106*o* and 106*p* is brought into contact with the first or second regulating button, the whippen assembly 106*b* still turning around the whippen flange 106*a* causes the jack 106*e* to turn around a pin PN in the clockwise direction against the elastic force of the repetition spring 106*f*. Then, the jack 106*e* escapes from the hammer roller 107*c*, and the hammer assembly 107 rushes toward the set of strings 104.

The hammer head 107*d* rebounds on the set of strings 104, and the hammer roller 107*c* is brought into contact with the repetition lever 106*d*. The hammer roller 107*c* impacts on the repetition lever 106*d*, and the repetition lever 106*d* turns around the repetition flange 106*c* in the clockwise direction against the elastic force of the repetition spring 106*f*. The hammer assembly 107 is finally received by a back-check 114. On the other hand, when the black/white key 101*a*/101*b* is slightly lifted from the end position, the hammer head 107*d* is released from the back check 114, and the repetition spring 106*f* rotates the repetition lever 106*d* in the counter clockwise direction. As a result, the hammer assembly 107 turns in the clockwise direction over a small angle, and the jack 106*e* comes into contact with the hammer roller 107*c*.

The damper mechanism 111 comprises a damper lever flange 111*a* fixed to the damper lever rail 112, a damper lever 111*b* turnably supported by the damper lever flange 111*a*, a damper block 111*c* functionally connected to the leading end of the damper lever 111*b*, a damper wire 111*d* upwardly projecting from the damper block 111*c* and a damper head 111*e* connected to the leading end of the damper wire 111*d*. While the black/white key 101*a*/101*b* is resting, the rear end portion of the key 101*a*/101*b* is downwardly spaced from the leading end of the damper lever 111*b*, and the damper head 111*e* is held in contact with the set of strings 104 by the self-weight.

When the player depresses the key 101*a*/101*b*, the rear end of the depressed key 101*a*/101*b* upwardly pushes the damper lever 111*b*, and the damper lever 111*b* turns around the damper lever flange 111*a* in the counter clockwise direction. A damper guide rail 115 guides the damper wire 111*d*, and the damper wire 111*d* causes the damper head 111*e* to leave the set of strings 104. The set of strings 104 is allowed to vibrate, and generates the acoustic tone upon impact of the hammer head 107*d*.

When the player releases the key 101*a*/101*b*, the rear end portion sinks, and allows the damper lever 111*b* to turn around the damper lever flange 111*a* in the clockwise direction. The damper head 111*e* is brought into contact with the set of strings 104, and the vibrations of the strings 104 is taken up by the damper head 111*e*.

The key action mechanisms 106, the hammer assemblies 107 and the damper mechanisms 111 behave as similar to those of a standard grand piano except for the regulating button mechanisms 106*g*.

The behavior of the key action mechanism 106 is hereinbelow analyzed in detail. Assuming that the jack 106*e* escapes from the hammer roller 107*c* after a contact of the second semi-spherical portion 106*p* with the second regulating button 106*s*, the distance between the point of application and the fulcrum, i.e., between the second semi-spherical portion 106*p* and a pin member PN is decreased to a half of the distance between the first semi-spherical portion 106*p* and the pin PN, and the angular velocity of the jack 106*e* and the angle of the rotation are increased to the twice of those of the jack 106*e* escaping through the contact between the first semi-spherical portion 106*o* and the first regulating button 106*r*. When paying attention to the top surface of the long portion 106*h*, the horizontal component force is rather large than the vertical component force due to the increased angular velocity, and allows the jack 106*e* to escape from the hammer roller 107*c* earlier than the escape through the contact between the first semi-spherical portion 106*o* and the first regulating button 106*r*. Thus, the jack 106*e* escapes from the hammer roller 107*c* at a longer distance between the hammer head 107*d* and the strings 104.

In fact, when the first semi-spherical portion 106*o* was brought into contact with the first regulating button 118, the jack 106*e* escaped from the hammer roller 107*c* at the distance of 3 millimeter. On the other hand, the contact between the second semi-spherical portion 106*p* and the second regulating button 106*s* caused the jack 106*e* to escape from the hammer roller 107*c* at the distance of about 5 millimeters, and the difference was about 2 millimeters.

The increased angular velocity makes the vertical component force decreased, and completes the escape early. The jack 106*e* transmits the vertical force over a shorter time, and slowly rotates the hammer assembly 107. The hammer assembly gently strikes the strings 104, and the stings 104 generate a soft acoustic tone through weak vibrations. Even though the distance between the hammer head and the strings becomes wider at the escape, the second semi-spherical portion 106*p* is brought into contact with the second regulating button 106*s* at the same timing as the contact between the first semi-spherical portion 106*p* and the first regulating button 118, and the key touch is not changed among the standard acoustic sound mode, the muting mode and the silent mode.

The ratio of the angular is variable together with the position of the second semi-spherical portion 106*p* on the short portion 106*i*, and affects the hammer motion as described hereinbefore. However, if the second semi-spherical portion 106*p* is too close to the pin PN, the angle of rotation of the long portion 106*h* is excessively increased, and is violently brought into collision against the inner wall of the repetition lever 106*d*. The collision may break the key action mechanism 106. On the other hand, if the second semi-spherical portion 106*p* is too close to the first semi-spherical portion 106*o*, the distance of the hammer head cloest to the strings is unchanged among the standard acoustic sound mode, the muting mode and the silent mode, and the hammer shank 107*b* may get between the jack 106*e* and a shank stopper which is described hereinlater. The present inventors took these problems into account, and decided the second semi-spherical portion 106*p* at the intermediate point of the short portion 106*i*.

Figure 6:
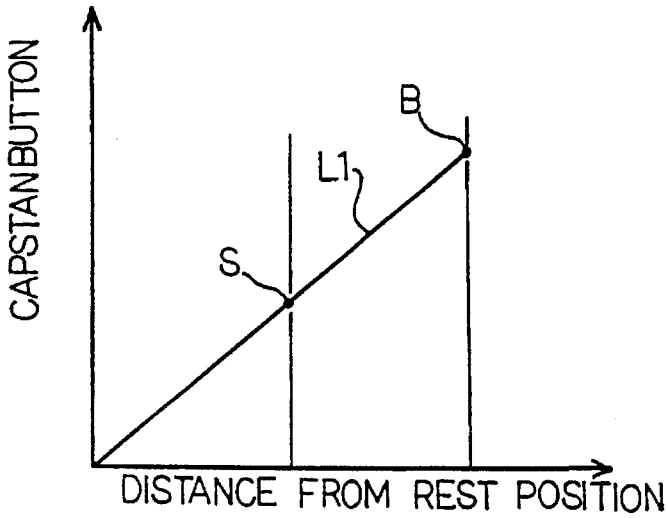
FIG. 6 is a graph showing relation between a key motion and a motion of capstan button.
Figure 7:
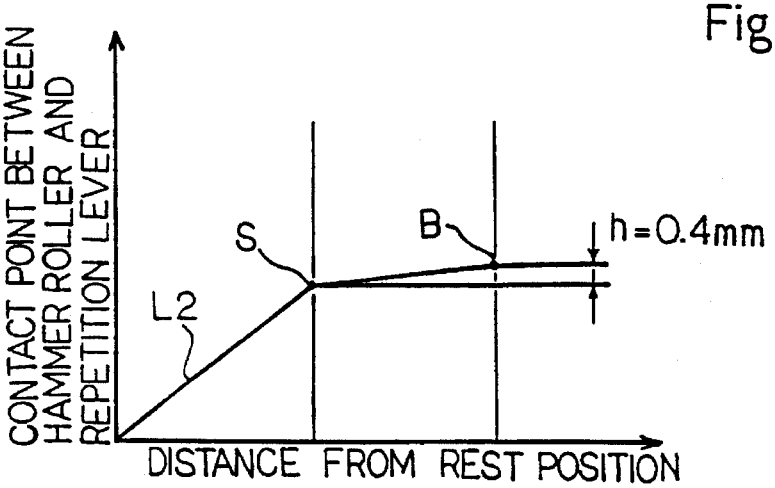
FIG. 7 is a graph showing relation between the key motion and a contact point between a repetition lever and a hammer roller.
Figure 8:
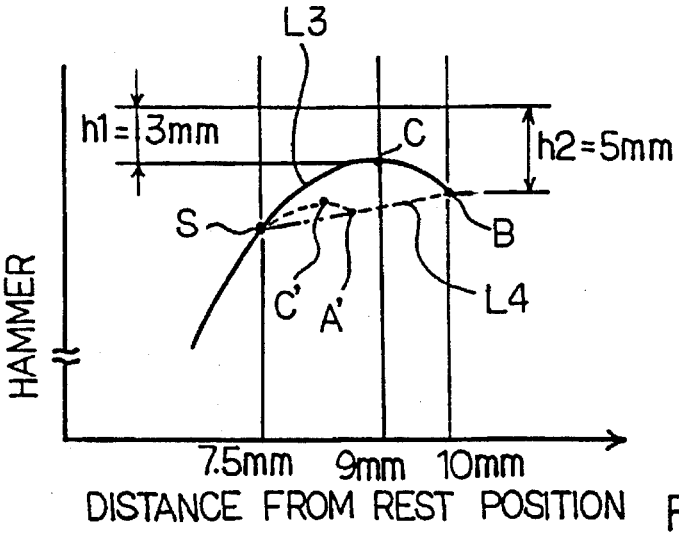
FIG. 8 is a graph showing relation between the key motion and a hammer motion.

FIGS. 6 to 8 illustrate motions of the key action mechanism 106, and each abscissa is indicative of a distance of the key 101*a*/101*b* from the rest position. The jack 106*e* starts the escape at point S, and the key 101*a*/101*b* reaches the end position at point B. While a player is slowly depressing the key 101*a*/101*b* from the rest position to the end position, the capstan button 110 roughly traces linear line L1 as shown in FIG. 4, and the contact point between the hammer roller 107*c* and the repetition lever 106*d* also roughly traces linear line L2 until point S (see FIG. 7). When the jack 106*e* starts the escape, the repetition lever is brought into contact with the drop screw 107*e*. After the contact with the drop screw 107*e*, the capstan button 110 still rises, and rotates the repetition lever 106*d* in the clockwise direction in FIG. 1 between point S and point B. As a result, the contact point between the hammer roller 107*c* and the repetition lever 106*d* gently rises. The rise h is about 0.4 millimeter.

The hammer assembly 107 traces real line L3 in the standard acoustic sound mode (see FIG. 8), and broken line L4 in the muting/silent mode. In the muting/silent modes, the jack completes the escape at point A', and the finishing point of escape A' is earlier than the finishing point of escape B in the standard acoustic sound mode. Point C is indicative of the maximum height of the hammer when the key 101*a*/101*b* is gently depressed. Point C is spaced from the strings 104 by 3 millimeters. The jack 106*e* supports the hammer roller 107*c* along path S-C-B and or S-C'-A', and directly transfers the force due to the key motion to the hammer roller 107*c*. In the muting and silent mode, the repetition lever 106*d* supports the hammer roller 107*c* along path A'-B, and the hammer roller 107*c* gently rises together with the repetition lever 106*d*. For this reason, the force due to the key motion is indirectly transferred through the repetition lever 106*d* to the hammer roller 107*c*. The hammer assembly 107 rises seven to eight times wider than the hammer roller 107*c*, and the gradient of the path between point A' and B is also seven to eight times larger than the height of the repetition lever 106*d* between point S and point B. While the key 101*a*/101*b* is being gently depressed, the key-touch like a click is given between the path S-C-B or S-C'-A' due to the friction force between the jack 106*e* and the hammer roller 107*c*.

Relation among points A', B, C, C' and S is expressed as C>B>C'>A'>S. In the muting/silent modes, jack 106*e* approaches the hammer roller 107*c* to the strings 104 by the distance between the point C' and the strings 104; however, the distance of the hammer head closest to the strings h2 is 5 millimeters at the point B. Dots-and-dash line is representative of the motion of the hammer 107 pressed by the repetition lever 106*d* only, i.e., without the jack 106*e*, and the path of the hammer 107 is matched partially with the real line until point S and partially with the broken line L4 between A' and B.

In this instance, the distance between the hammer head 107*d* and the strings 104 is regulated as shown in the following table. The interrupt point with the shanks stopper 210 is further shown in the table. In the table, "distance" means the distance between the hammer head and the associated strings.

TABLE

| Distance | high tone range | intermediate tone range | middle tone range | low tone range |
|---|---|---|---|---|
| Standard acoustic sound mode | 1.5 | 2.0 | 2.5 | 3 |
| Silent mode | 3.5 | 4.0 | 4.5 | 5.0 |
| Inter-ruption | 3.0 | 3.0 | 4.0 | 5.0 |

Figure 9:
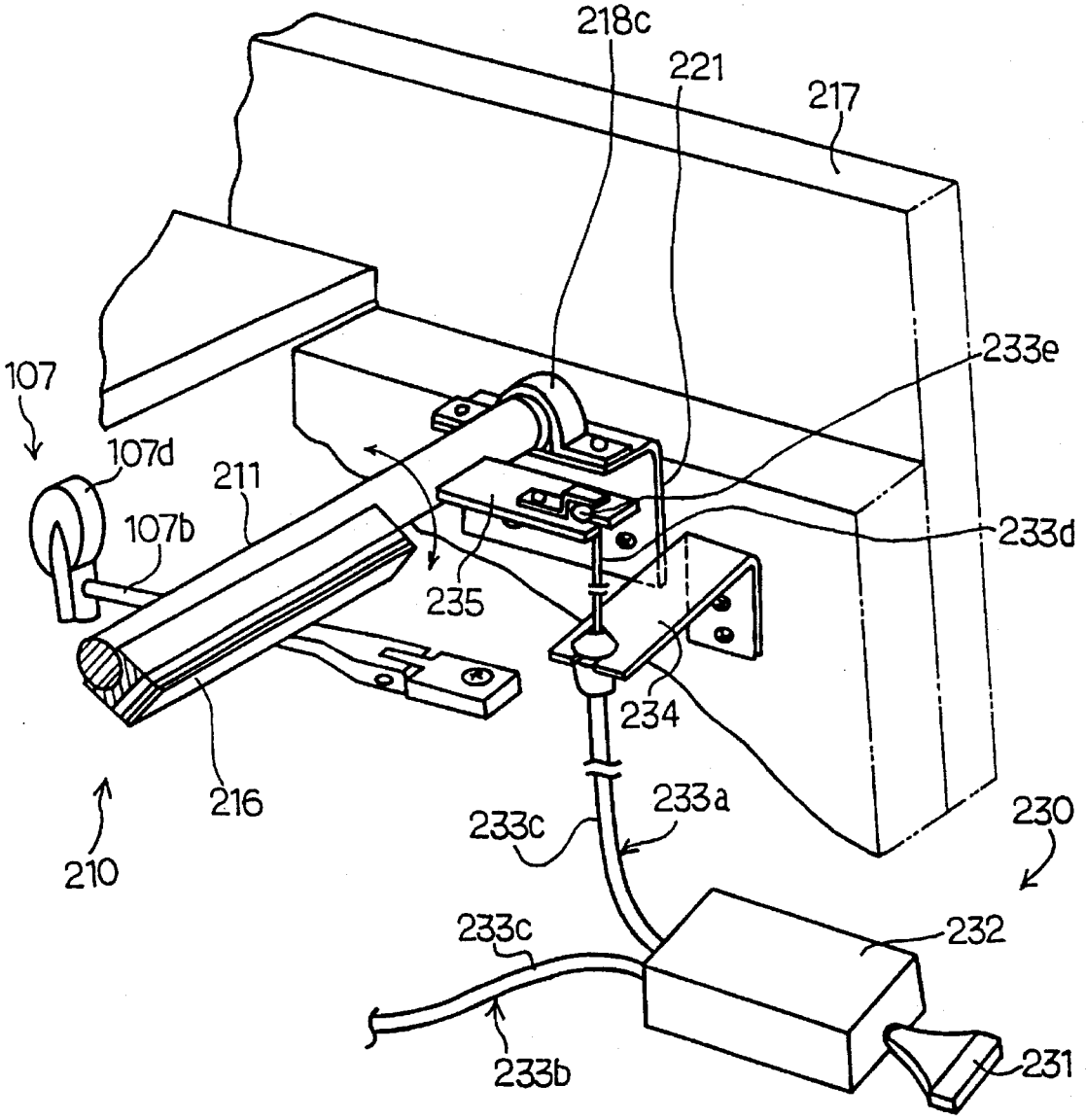
FIG. 9 is a perspective view showing a silent system incorporated in the keyboard musical instrument.
Figure 10:
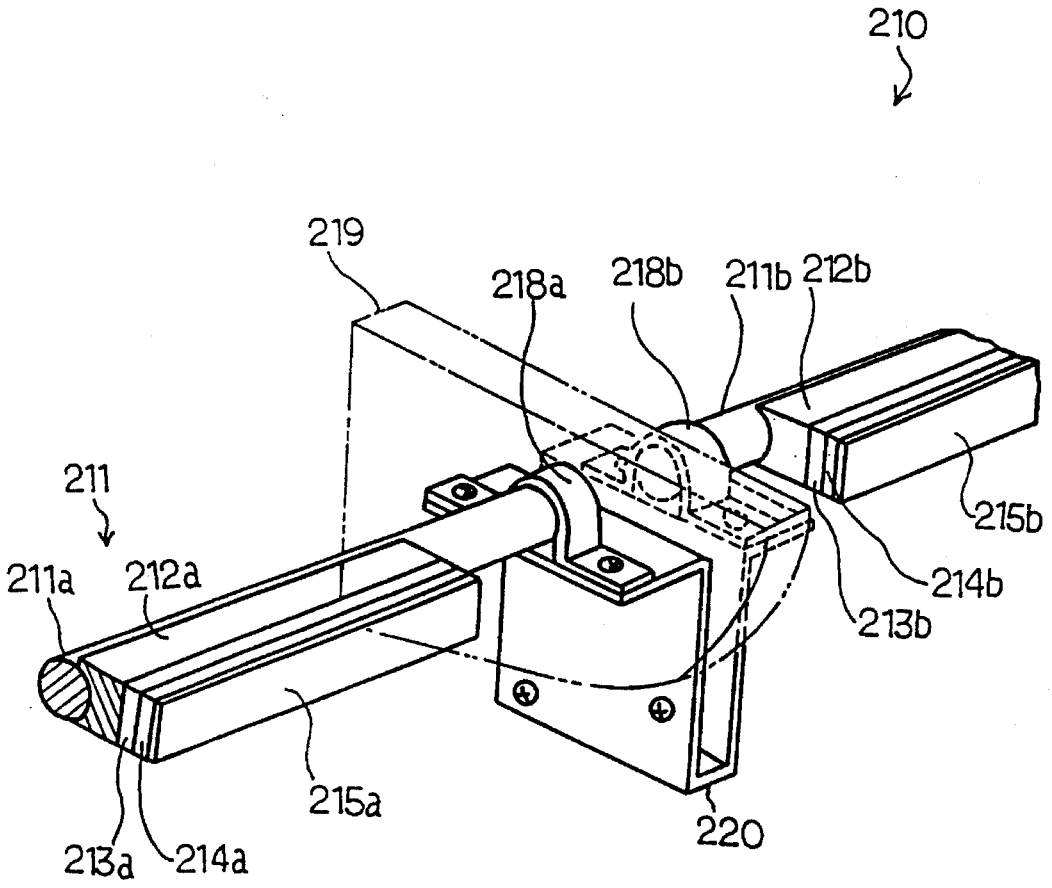
FIG. 10 is a perspective view showing the silent system from another angle.

Referring to FIGS. 9 and 10 concurrently with FIG. 1, the silent system 200 comprises a shank stopper 210 changeable between a free position FP and a blocking position BP and a change-over mechanism 230 connected to the shank stopper 210. The shank stopper 210 is provided in a space between the strings 104 and the hammer shanks 107*b* at the home position, and is split into two stopper sections (see FIG. 10). One of the stopper sections is provided for the sets of strings assigned to low-pitched tones, and the other stopper section is provided for the sets of strings assigned to middle-pitched tones and high-pitched tones.

The shank stopper 210 comprises a rod member 211 split into two sections 211*a* and 211*b*, cushion brackets 212*a* and 212*b* respectively attached to the two sections 211*a* and 211*b*, lower cushion members 213*a* and 213*b* attached to the cushion brackets 212*a* and 212*b*, upper cushion members 214*a* and 214*b* fixed to the lower cushion members 213*a* and 213*b* and protective skins 215*a* and 215*b* fixed to the upper cushion members 214*a* and 214*b*. The lower cushion members 213*a* and 213*b*, the upper cushion members 214*a* and 214*b* and the protective skins 215*a* and 215*b* form a cushion unit 216.

The section of the shank stopper 210 for the strings 104 assigned to the low-pitched tones is rotatably supported at one end thereof by a bearing unit (not shown) attached to an inner surface of a side board 217 and at the other end thereof by a bearing unit 218*a* attached to a board 219 by means of a bracket 220. Though not shown in FIGS. 9 and 10, the section of the shank stopper 210 for the strings 104 assigned to the low-pitch tones is further supported at an intermediate portion by a bearing unit.

The section of the shank stopper 210 for the strings 104 assigned to the middle-pitched/high-pitched tones is rotatably supported at one end thereof by a bearing unit 218*b* fixed to the bracket 220 and at the other end thereof by a bearing unit 218*c* fixed through a bracket 221 to an inner surface of the side board 217. The intermediate portion is also rotatably supported by a bearing unit (not shown).

The cushion brackets 212*a* and 212*b* are formed of wood, aluminum alloy or iron, and the upper cushion members 214*a* and 214*b* are different in the modulus of elasitisity from the lower cushion members 213*a* and 213*b*. The protective skins 215*a* and 215*b* are formed of leather or synthetic resin.

The change-over mechanism 230 comprises a grip 231 manipulated by a player, a case 232 slidably supporting the grip 231, transmitting cords 233*a* and 233*b* connected to the grip 231, bracket 234 fixed to the inner surfaces of the side board 217 and arm members 235 fixed to the sections 211*a*/211*b* of the rod member 211. Each of the transmitting cords 233*a* and 233*b* is formed by a stationary flexible tube 233*c* and a flexible wire 233*d*. The flexible tube 233*c* is fixed between the bracket 234 and the case 232, and the movable flexible wire 233*d* is slidably inserted into the flexible tube 233*c*. The movable flexible wire 233*d* has a ball 233*e* fixed to the leading end of the flexible wire 233*d*, and is engaged with the bracket member 235.

If the player pulls the grip 231, the flexible wires 233*d* slides in the flexible tubes 233*c*, and pulls down the arm members 235. Then, the shank stopper 210 is changed from the free position FP to the blocking position BP, and the cushion unit 216 is opposed to the hammer shanks 107*b*. While the shank stopper 210 is resting in the free position FP, the hammer heads 107*d* rebound on the associated sets of strings 104 without an interruption of the shank stopper 210 . However, the shank stopper 210 in the blocking position BP causes the hammer shanks 107*b* to rebound thereon without an impact on the strings 104. The shank stopper 210 enters into the blocking position BP in the silent mode, and rests in the free position FP in the standard acoustic sound mode and the muting mode.

The shank stopper 210 retracts the cushion unit 216 in an upper space higher than the lower surface of the pin board PB (see FIG. 1), and the keyboard 101, the key action mechanisms 106 and the hammer assemblies 107 can be taken out together without an interruption of the shank stopper 210 for a tuning operation.

Turning back to FIG. 1 of the drawings, the electronic sound generating system 300 largely a controlling unit 301, a plurality of key sensors 302, a plurality of hammer sensors 303, a plurality of pedal sensors 304 and a headphone 305, and key codes are respectively assigned to the black and white keys 101*a*/101*b*. A speaker system may be incorporated in the electronic sound generating system 300 together with or instead of the headphone 305. A typical example of the key sensor 302 and a typical example of the hammer sensor 303 are disclosed in Japanese Patent Publication of Unexamined Application No. 59-24894.

The plurality of key sensors 302 is respectively associated with the plurality of black and white keys 101*a* and 101*b*, and each of the key sensors 302 comprises a shutter plate fixed to the bottom surface of the associated key 101*a*/101*b* and photo-interrupters mounded on the key frame 102 along the respective paths of the associated shutter plates. The shutter plate is moved together with the associated key 101*a*/101*b*, and the photo-interrupters monitors the motion of the associated shutter plate and, accordingly, the motion of the associated key 101*a*/101*b*. The key sensors 302 supply the controlling unit 301 key position signals each indicative of a current key position of the associated key 101*a*/101*b*.

The hammer sensors 303 are respectively provided for the hammer assemblies 107, and a shutter plate and photo-interrupters form each of the hammer sensors 303. The photo-interrupters are positioned in such a manner as to detect the hammer motion immediately before the impact on the strings 104, and the hammer sensors 303 supplies the controlling unit 301 hammer position signals each indicative of a variation of current position of the associated hammer assembly 107. The final hammer velocity immediately before the impact on the strings 104 is proportional to the strength of the impact, and the controlling unit 301 can determines the loudness of an electronic sound. The hammer sensors 303 cooperates with the associated key sensors 302, and cause the controlling unit 301 to decide the notes of electronic sounds corresponding to depressed keys 101*a*/101*b* and the loudness of each electronic sound.

The pedal sensors 304 monitor three pedals of the grand piano 100 to see whether or not the player steps on any one of the three pedals. If the player steps on one of the pedals, the associated pedal sensor 304 detects the motion of the pedal, and report the position of the manipulated pedal to the controlling unit 301.

Figure 11:
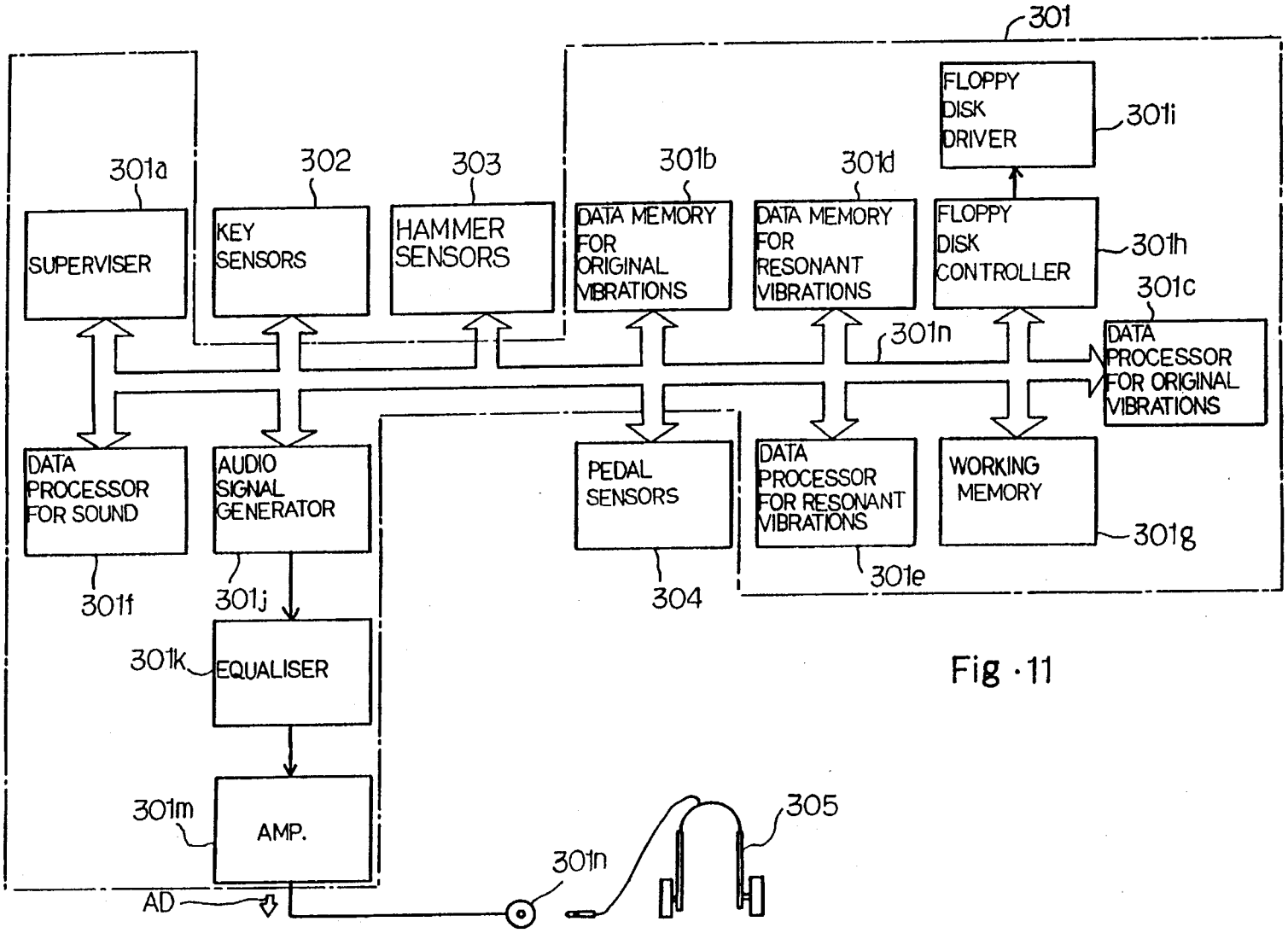
FIG. 11 is a block diagram showing the arrangement of an electronic sound generating system incorporated in the keyboard musical instrument.

Turning to FIG. 11 of the drawings, the controlling unit 301 comprises a supervisor 301*a*, a data memory 301*b* for original vibrations, a data processor 301*c* for original vibrations, a data memory 301*d* for resonant vibrations, a data processor 301*e* for resonant vibrations, a data processor 301*f* for sound spectrum, a working memory 301*g*, a floppy disk controller 301*h*, a floppy disk driver 301*i*, an audio signal generator 301*j*, an equalizer 301*k*, an amplifier 301*m* and a bus system 301*n*.

The supervisor 207 sequentially scans signal input ports assigned to the mode control signal MODE, the key position signals supplied from the key sensors 202, the hammer position signals supplied from the hammer sensors 303, the detecting signals from the pedal sensors 304, and supervises the other components 301*b* to 301*h* and 301*j* for producing a digital audio signal. The audio signal generator 301*j* generates an analog audio signal AD from the digital audio signal.

An internal table is incorporated in the supervisor 301*a*, and the internal table defines relation between the key code, the final hammer velocity and timings for producing the audio signal. The audio signal AD is supplied from the equalizer 301*k* to the amplifier unit 301*m*, and the audio signal AD is transferred through the socket 301*n* to the headphone 305 for reproducing a music.

The data memory 301*b* for original vibrations stores a plurality sets of pcm (Pulse Code Modulation) data codes indicative of frequency specular of original vibrations on the strings 104, and each set of pcm data codes is corresponding to one of the black and white keys 101*a* and 101*b*. A plurality groups of pcm data codes form a set of pcm data codes, and are corresponding to frequency specular at different intensities or the final hammer velocities. In general, if the hammer head 107*d* strongly strikes the associated string 104, higher harmonics are emphasized.

The plurality sets of pcm data codes are produced with a sampler (not shown) through sampling of actual vibrations on the sets of strings 104 at appropriate sampling frequency. The set of pcm data codes may be produced by means of the data processor 301*f* in a real-time manner.

Using a group of pcm data codes, original vibrations produced upon depressing the key 101*a* or 101*b* are restored, and the supervisor 301*a* controls the sequential access to a group of pcm data codes stored in the data memory 301*b*.

The data processor 301*c* for original vibrations is provided in association with the data memory 301*b*, and modifies a group of pcm data codes for an intermediate final hammer velocity. The modification with the data processor 301*c* is also controlled by the supervisor 301*a*.

As described hereinbefore, the intensity of frequency spectrum is dominated by the final hammer velocity. However, the intensities are variable with the type and model of the acoustic piano.

The data memory 301*d* for resonant vibrations stores a plurality sets of pcm data codes indicative of resonant vibrations, and the resonant vibrations take place under step on the damper pedal. While a player steps on the damper pedal, the damper heads 111*e* are held off, and some of the strings 104 are resonant with the strings 104 directly struck by the associated hammer head 107*d*. The resonant tones range −10 dB and −20 dB with respect to the tone originally produced through strike with the hammer head 107*d*, and time delay of several milliseconds to hundreds milliseconds is introduced between the originally produced tone and the resonant tones.

If the player continuously steps on the damper pedal, the resonant tones continues several seconds. On the other hand, the player can rapidly terminate the original and resonant tones by releasing the damper pedal, and the audio signal generator 301*j* is responsive to the detecting signal of the pedal sensors 304 for the rapid termination of the electronic sound.

The pcm data codes stored in the data memory 301*d* are indicative of frequency specular of the resonant vibrations, and are also produced by means of the sampler or the data processor 301*e* for resonant vibrations.

Each of the plurality sets of pcm data codes for the resonant tones is addressable with one of the depressed keys 101*a* or 101*b*, and is constituted by six groups of pcm data codes at the maximum. Each group of pcm data codes is corresponding to one of the resonant strings 104, and the second harmonic to the sixth harmonic are taken into account for strings 104 one octave higher than low-pitched tones. However, if the depressed key 101*a*/101*b* is lower than the thirteenth key from the lowest key of the eighty-eight key arrangement, the strings 104 one octave lower than the depressed key should be taken into account.

A set of pcm data codes are sequentially read out from the data memory 301*d* depending upon the depressed key 101*a* or 101*b* under the control of the supervisor 301*a*, and the data processor 301*e* for resonant vibrations modifies the pcm data codes for an intermediate intensity. The memory capacity of the data memory 301*d* may be large enough to store the pcm data codes at all of the detectable final hammer velocities, and the data processor 301*e* may calculate each set of pcm data codes on the basis of parameters stored in the data memory 301*d*.

The data processor 301*f* for sound spectrum can produce not only a group of pcm data codes indicative of frequency spectrum for original vibrations but also a set of pcm data codes indicative of frequency specular for resonant vibrations as described hereinbefore. The data processor 301*f* is further operative to cause the frequency specular to decay. In detail, when a player releases a key of an acoustic piano, original vibrations on a set of strings rapidly decays, because an associated damper head is brought into contact with the strings. The data processor 301*f* simulates the decay of the vibrations in the acoustic piano, and sequentially decreases the values of the pcm data codes. The resonant tones continue for several seconds in so far as the player keeps the damper pedal in the depressed state. On the other hand, if the player releases the damper pedal, the resonant tones are rapidly decayed. The data processor 301*f* also simulates the decay, and sequentially decreases the values of the pcm data codes for the resonant vibrations.

The decay is not constant. If the player releases the damper pedal through a half pedal position, the tones decay at lower speed than the ordinary release. Moreover, some players use the half pedal in such a manner as to retard low-pitched tones rather than high-pitched tones, and such a pedal manipulation is called as an oblique contact. On the contrary, if the damper pedal causes all the dampers to be simultaneously brought into contact with the strings, the damper manipulation is referred to as simultaneous contact. The data processor 301*f* can simulate the gentle decay for the release through the half pedal as well as the oblique contact, and the values of the pcm data codes are decreased at either high, standard or low speed in the simultaneous contact and at different speed in the oblique contact. The data processor 301*f* may change the ratio between the fundamental tone and the harmonics thereof for the half pedal, and decay high-order harmonics faster than the fundamental tone. The frame of an acoustic piano usually vibrates, and the frame noises participate the piano sound. The data processor 301*f* may take these secondary noises into account and modify the frequency ratio.

The audio signal generator 301*j* comprises a digital filter, a digital-to-analog converter and a low-pass filter, and produces the analog audio signal AD from the pcm data codes supplied from the data memories 301*b* and 301*d* and/or the data processors 301*c*, 301*e* and 301*f*. The pcm data codes are subjected to a digital filtering, and are, then, converted into the analog audio signal AD. If a speaker system is employed, the vibration characteristics of the speaker system and vibratory characteristics of the speaker box are taken into account for the digital filtering, and the pcm data codes are modified in such a manner that the frequency spectrum of produced sounds becomes flat. The digital filter is of the FIR type. However, an IIR type digital filter is available. An oversampling type digital filter may follow the digital filtering for eliminating quantized noises.

After the digital filtering, the digital-to-analog converter produces the analog audio signal AD, and the analog audio signal AD is filtered by the low-pass filter. The low-pass filter is of a Butterworth type for improving group delay. The analog audio signal AD thus filtered is supplied through the equalizer 301*k* to the amplifier unit 301*m*, and the amplifier unit 301*m* amplifies the analog audio signal AD for driving the headphone 305.

The floppy disk driver 301*i* reads out music data codes formatted in accordance with the MIDI standards from a floppy disk under the control of the floppy disk controller 301*h*, and the supervisor 301*a* allows the audio signal generator 301*j* to reproduce sounds from the music data codes read out from the floppy disk. Therefore, a music can be reproduced in the timbre of another musical instrument such as, for example, a pipeorgan, a harpsichord or a wind musical instrument.

The supervisor 301*a* may format pieces of key code information and pieces of music information produced from the key position signals, the hammer position signals and the detecting signals in accordance with the MIDI standards, and the MIDI codes are stored in a floppy disk under the control of the floppy disk controller 301*h*. If the keyboard instrument can record and reproduce a performance, the keyboard instrument has five modes of operation, i.e., the standard acoustic sound mode, the muting mode, the silent mode, the recording mode and the playback mode.

Description is hereinbelow made on the three modes of operation. When a player performs a music in the standard acoustic sound mode, the player maintains the shank stopper 107*b* in the free position FP, and the second regulating buttons 106*s* are held in the idling position. While the player is selectively depressing the black and white keys 101*a* and 101*b*, the capstan buttons 110 upwardly push the whippen assemblies 106*b*, and the contact between the first semi-spherical portions 106*o* and the first regulating buttons 106*r* cause the jacks 106*e* escape from the hammer rollers 107*c*. Upon the escape, the jacks 106*e* kick the hammer rollers 107*c* for rotation, and the hammer heads 107*d* rebound on the sets of strings 104. The strings 104 vibrate for generating the acoustic tones. If the player step on the damper or shift pedal, the acoustic tones are prolonged or softened. Thus, the player performs the music on the keyboard 101 of the grand piano 100.

Assuming now that the player wants to decrease the loudness of the acoustic tones, the player changes the second regulating buttons 106*s* into the active position, but maintains the shank stopper 210 in the free position FP. While the player is selectively depressing the black and white keys 101*a* and 101*b*, the capstan buttons 110 push up the whippen assemblies 106*d*, and rotate the whippen assemblies 106*d* in the counter clockwise direction in FIG. 1. The second semi-spherical portions 106*p* are brought into contact with the second regulating buttons 106*s*, and the contact between the second semi-spherical portions 106*p* and the second regulating buttons 106*s* causes the jacks 106*e* to escape from the hammer rollers 107*c*. Since the starting point of the escape is substantially identical with the starting point of the escape through the contact between the first semi-spherical portion 106*o* and the first regulating button 106*r*, the player feels the key-touch identical.

As described hereinbefore, the jacks 106*e* quickly escape from the hammer rollers 107*c*, and impart the driving forces smaller than those in the standard acoustic sound mode. For this reason, the hammer assemblies 107 is slowly rotated toward the strings 104, and softly strike the sets of strings 104. The strings 104 generate soft acoustic sounds, and the damper/shift pedals can impart the same effects as in the standard acoustic sound mode.

Finally, the player is assumed to change the shank stopper 210 into the blocking position BP and keep the second regulating buttons 106*s* at the active position. The keyboard musical instrument enters into the silent mode. Even though the cushion unit 216 enters into the paths of the hammer shanks 107*b*, the hammer shanks 107*b* do not get between the jacks 106*e* and the shank stopper 210, because the jacks escape from the hammer rollers before the hammer shanks are brought into contact with the shank stopper.

The hammer assemblies 107 are rotated toward the strings 104, but rebound on the shank stopper 210 before an impact of the hammer head 107*d* on the strings 104. The hammer assemblies 107 return to the home positions, and are received by the back checks 114 as described hereinbefore.

The key sensors 302 and the hammer sensors 303 reports the key motions and the hammer motions to the controlling unit 301, and the controlling unit 301 generates the analog audio signal AD from the key position signals and the hammer position signals. The analog audio signal AD is supplied to the headphone 305, and the player enjoys the performance through the headphone 305 without an acoustic tone.

While the player is selectively depressing the black and white keys 101*a* and 101*b*, the jacks 106 escape from the hammer rollers 107*c* through the contacts between the second semi-spherical portions 106*p* and the second regulating buttons 106*s* as similar to the muting mode. Although the starting point of the escape is the same as that of the standard acoustic sound mode, the jack 106 completes the escape earlier than that in the standard acoustic sound mode.

As will be appreciated from the foregoing description, the keyboard musical instrument according to the present invention allows a player to perform a music with the ordinary/soft acoustic piano tones or the electronic sounds, and the key touch is not changed in any mode.

In the first embodiment, the player independently manipulates the grips 116 and 231. In the first modification, a lock mechanism may be provided between the grips 116 and 231. The lock mechanism allows the grip 231 to pull both of the wires 233*d* and 117 together but the other grip 116 to pull the wire 117 only.

The second modification may not enter into the muting mode, and the grip 231 changes both of the shank stopper 210 and the second regulating buttons 106*s*.

The third modification may change the shank stopper 210 and/or the second regulating buttons 106*s* by means of a foot pedal, and a motor unit or a solenoid-operated actuator unit is available for changing the shank stopper 210 and/or the second regulating buttons 106*s*.

In the standard acoustic sound mode, the jack may also be brought into contact with the second regulating button so that the jack escapes, and the distance between the hammer head and the strings at the finishing point of the escape becomes wider.

Mufflers 400 (see FIG. 1) may be further incorporated in the keyboard musical instrument. The mufflers 400 are out of the paths of the hammer heads 107*d* in the standard acoustic sound mode, and are brought into contact with the strings 104 in the silent mode. The mufflers 400 do not allow the strings to vibrate, and perfectly remove the acoustic sounds.

Second Embodiment

Figure 12:
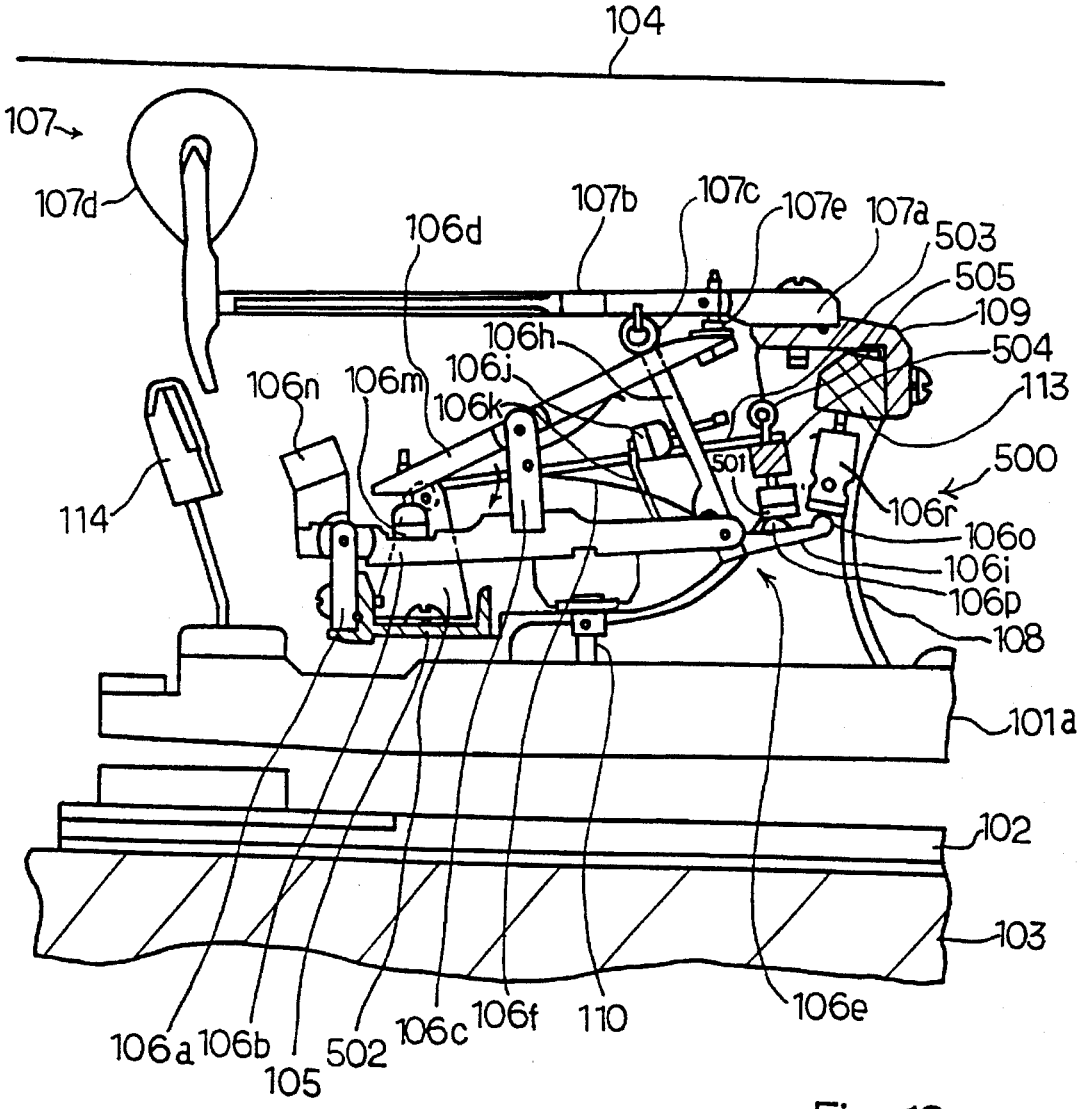
FIG. 12 is a side view showing a regulating button mechanism in a silent/muting modes incorporated in another keyboard musical instrument at a starting point of an escape according to the present invention.
Figure 13:
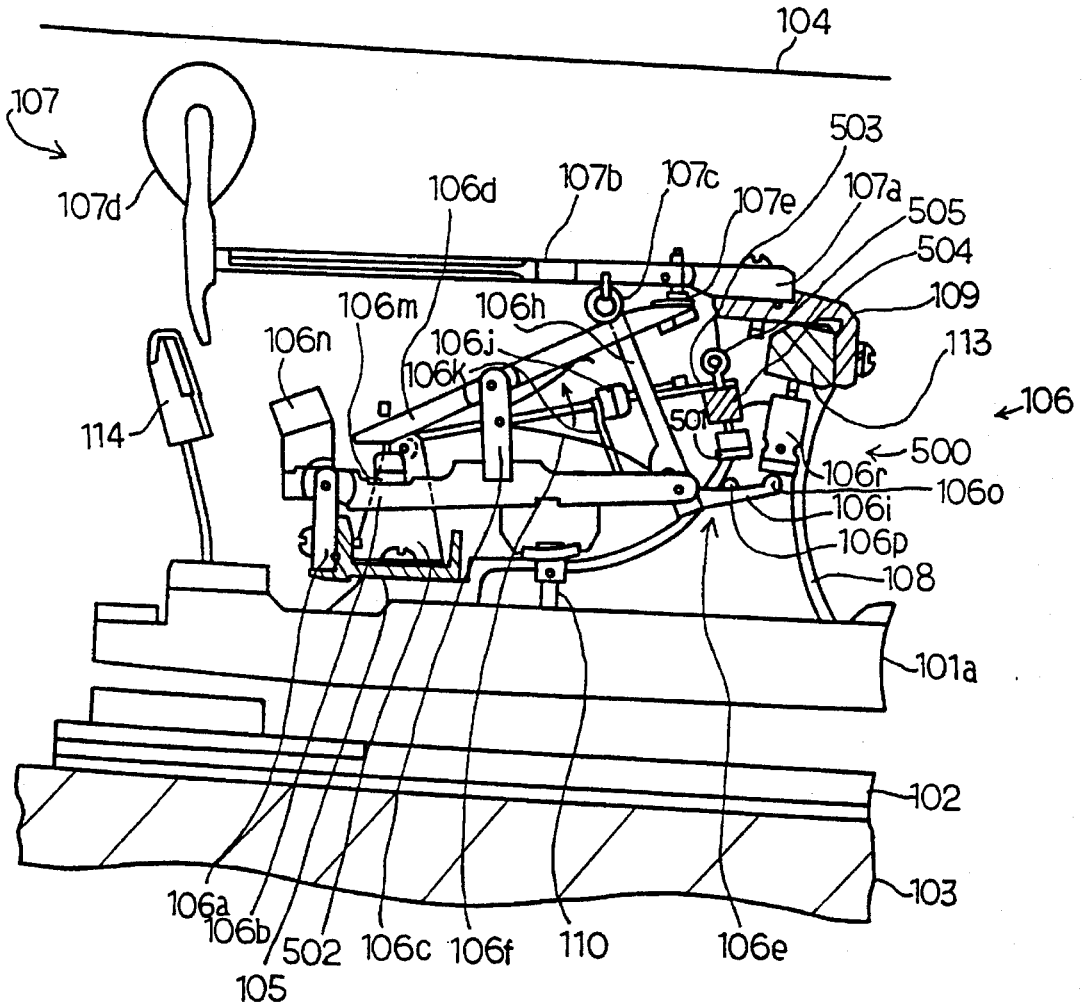
FIG. 13 is a side view showing the regulating button mechanism at a starting point of an escape in a standard acoustic sound mode.

Figures 12 and 13 illustrate a key action mechanism incorporated in another keyboard musical instrument embodying the present invention. The keyboard musical instrument implementing the second embodiment is similar to the first embodiment except for a regulating button mechanism 500, and, for this reason, description is focused on the regulating button mechanism 500. The component parts of the second embodiment are labeled with the same references designating corresponding parts of the first embodiment, and description is omitted for avoiding repetition.

The regulating button mechanism 500 comprises a first regulating rail 113, a plurality of first regulating buttons 106*r*, a plurality of second regulating buttons 501, brackets 502 fixed to the whippen rail 105, a plurality of arm members 503 rotatably connected to the brackets 502, a second regulating rail 504 connected to the leading ends of the arm members 503 and a plurality of second regulating screws 505 for connecting the second regulating buttons 501 to the second regulating rail 504. The second regulating buttons 501 are respectively provided for the jacks 106*e*, and are opposed to the second semi-spherical portions 106*p*. The second regulating screws 505 are turnable with respect to the second regulating rail 504, and adjust the gaps between the second semi-spherical portions 106*p* and the second regulating buttons 501 to appropriate values. Thus, the second regulating buttons 501 are similar to those of an upright piano, and a tuner can independently adjust the individual gaps between the second semi-spherical portions 106*p* and the second regulating buttons 501. Though not shown in FIGS. 12 and 13, an appropriate driving mechanism is connected to the arm members 503, and changes the second regulating buttons 501 between the idling position (see FIG. 13) and the active position (see FIG. 12).

The keyboard musical instrument implementing the second embodiment also selectively enters into the standard acoustic sound mode, the muting mode and the silent mode. The driving mechanism (not shown) maintains the second regulating buttons 501 in the active position in the muting and silent modes, and the jacks 106*e* escape from the hammer rollers 107*c* through the contact between the second semi-spherical portions 106*p* and the second regulating buttons 501.

On the other hand, while a player is performing a music in the standard acoustic sound mode, the driving mechanism (not shown) maintains the second regulating buttons 501 in the idling position, and the first semi-spherical portions 106*o* are brought into contact with the first regulating buttons 106*r* so that the jacks 106*e* escape form the hammer rollers 107*c*.

The keyboard musical instrument implementing the second embodiment achieves all of the advantages described in conjunction with the first embodiment.

Third Embodiment

Figure 14:
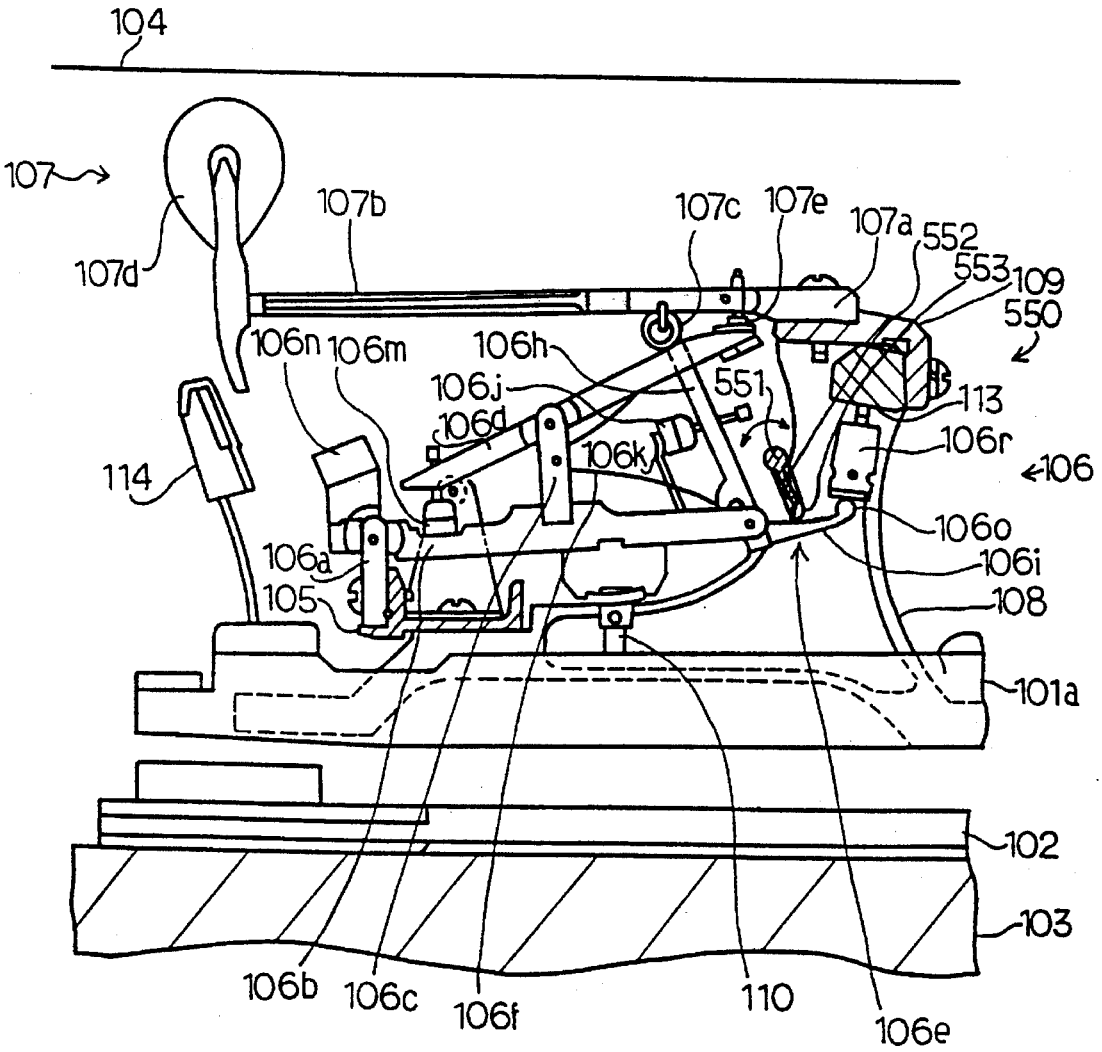
FIG. 14 is a side view showing a regulating button mechanism incorporated in yet another keyboard musical instrument at a starting point of an escape according to the present invention.

FIGS. 14 illustrates a key action mechanism incorporated in yet another keyboard musical instrument embodying the present invention. The keyboard musical instrument implementing the third embodiment is similar to the first embodiment except for a regulating button mechanism 550, and, for this reason, description is focused on the regulating button mechanism 550. The component parts of the third embodiment are labeled with the same references designating corresponding parts of the first embodiment, and description on these parts is omitted for the sake of simplicity.

The regulating button mechanism 550 comprises a first regulating rail 113, a plurality of first regulating buttons 106*r*, a rotatable shaft member 551, a plurality of projections 552 opposed to intermediate areas of the short portions 106*i* and a plurality of cushion sheets 553 covering the projections 552. The cushion sheets 553 are formed of felt, cloth or leather, and the short portions 106*i* are brought into contact with the cushion sheets 553 in the muting and silent modes. The projections 552 covered with the cushion sheets 553 are so thin that the second semi-spherical portions 106*p* are not formed on the short portions 106*i*. The projections 552 and the cushion sheets 553 form a plurality of second regulating buttons.

Though not shown in FIG. 14, an appropriate driving mechanism is connected to the shaft member 551, and changes the second regulating buttons between the idling position and the active position.

The keyboard musical instrument implementing the third embodiment also selectively enters into the standard acoustic sound mode, the muting mode and the silent mode. The driving mechanism (not shown) maintains the second regulating buttons in the active position in the muting and silent modes, and the jacks 106*e* escape from the hammer rollers 107*c* through the contact between the intermediate areas and the second regulating buttons.

On the other hand, while a player is performing a music in the standard acoustic sound mode, the driving mechanism (not shown) maintains the second regulating buttons in the idling position, and the first semi-spherical portions 106*o* are brought into contact with the first regulating buttons 106*r* so that the jacks 106*e* escape form the hammer rollers 107*c*.

The keyboard musical instrument implementing the third embodiment achieves all of the advantages described in conjunction with the first embodiment.

Fourth Embodiment

Figure 15:
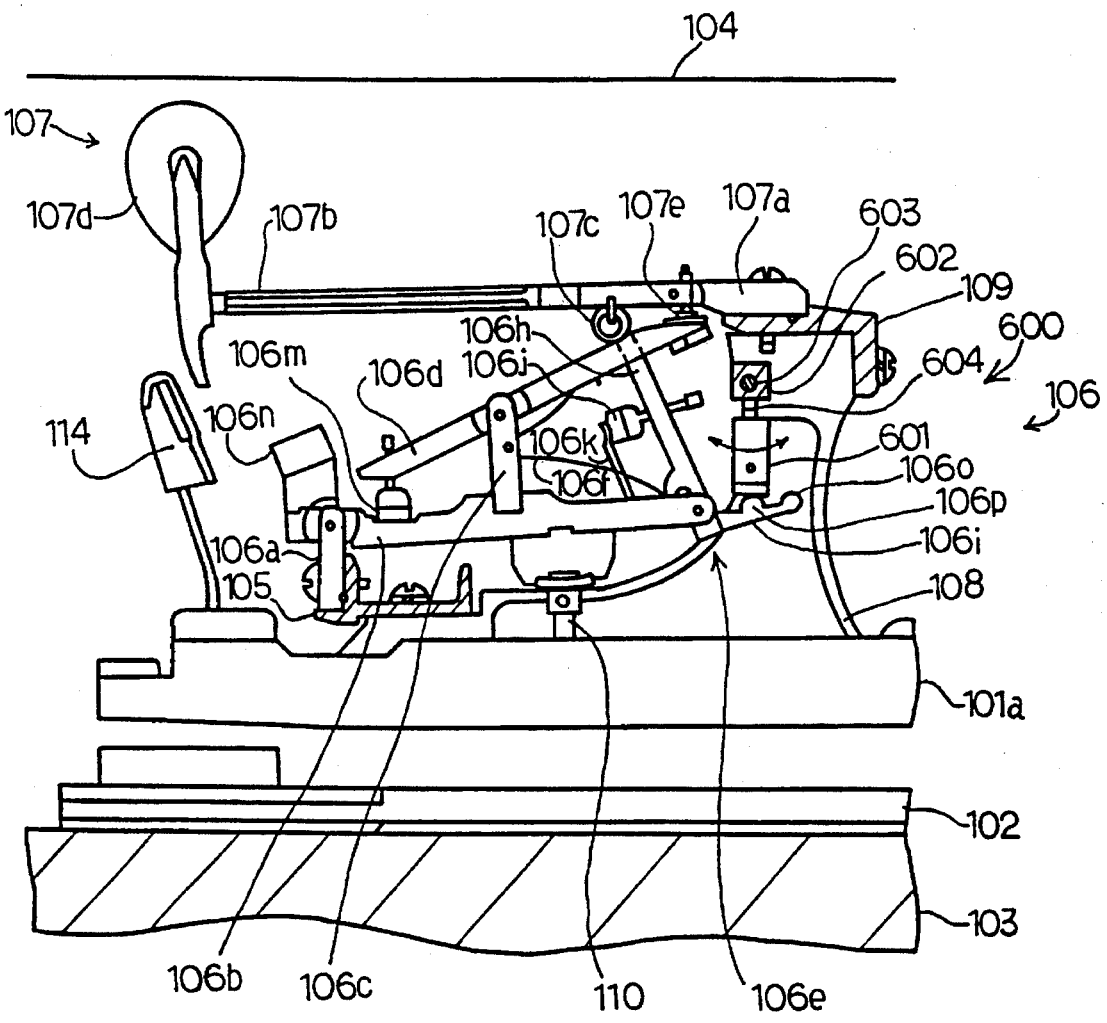
FIG. 15 is a side view showing a regulating button mechanism at a starting point of an escape in a silent/muting modes incorporated in still another keyboard musical instrument according to the present invention.
Figure 16:
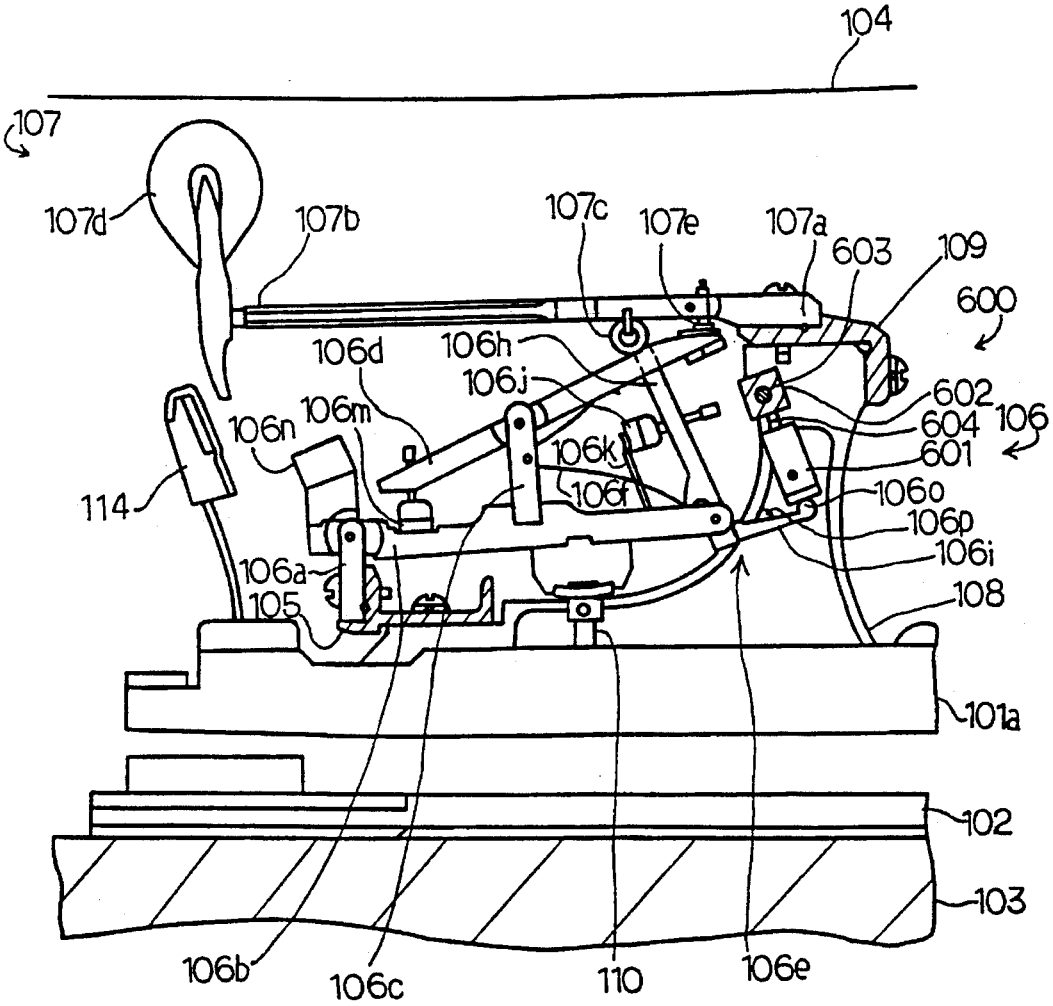
FIG. 16 is a side view showing the regulating button mechanism at a starting point of an escape in a standard acoustic sound mode.

FIGS. 15 and 16 illustrate a key action mechanism incorporated in still another keyboard musical instrument embodying the present invention. The keyboard musical instrument implementing the fourth embodiment is similar to the first embodiment except for a regulating button mechanism 600, and, for this reason, description is focused on the regulating button mechanism 600. The component parts of the fourth embodiment are labeled with the same references designating corresponding parts of the first embodiment, and description is omitted for avoiding repetition.

The regulating button mechanism 600 comprises a plurality of movable regulating buttons 601 respectively associated with the jacks 106*e*, a regulating rail 602 supporting the movable regulating buttons 601, a rotating shaft 603 rotatably supporting the regulating rail 602 and regulating screws 604. The regulating screws 604 are used for changing the gaps between the movable regulating buttons 601 and the short portions 106*i* of the jacks 106*e*.

Though not shown in FIGS. 15 and 16, an appropriate driving mechanism is connected to the shaft member 603, and changes the movable regulating buttons 601 between a muting/silent position (see FIG. 15) and an acoustic position (see FIG. 16).

The keyboard musical instrument implementing the fourth embodiment also selectively enters into the standard acoustic sound mode, the muting mode and the silent mode. The driving mechanism (not shown) changes the movable regulating buttons 601 in the muting/silent position in the muting and silent modes, and the jacks 106*e* escape from the hammer rollers 107*c* through the contact between the second semi-spherical portions 106*p* and the movable regulating buttons 601.

On the other hand, while a player is performing a music in the standard acoustic sound mode, the driving mechanism (not shown) changes the movable regulating buttons 601 in the acoustic position, and the first semi-spherical portions 106*o* are brought into contact with the movable regulating buttons 601 so that the jacks 106*e* escape form the hammer rollers 107*c*.

The regulating button mechanism 600 is simpler than that of the first embodiment, and the keyboard musical instrument implementing the fourth embodiment achieves all of the advantages described in conjunction with the first embodiment.

Fifth Embodiment

Figure 17:
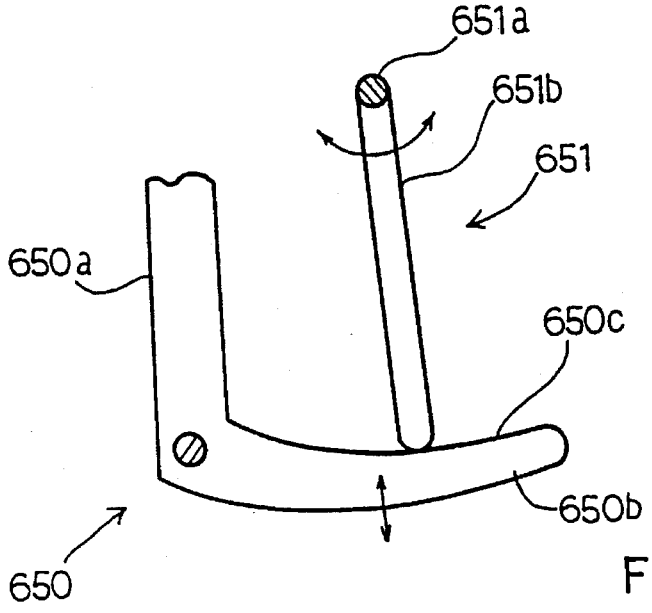
FIG. 17 is a side view showing a jack and a regulating button mechanism incorporated in a keyboard musical instrument according to the present invention.

FIG. 17 illustrates a jack 650 and a regulating mechanism 651 both incorporated in a keyboard musical instrument embodying the present invention. The keyboard musical instrument implementing the fifth embodiment is similar to the first embodiment except for the jack 650 and the regulating button mechanism 651.

The jack 650 has a long portion 650*a* and a short portion 650*b*, and the regulating button mechanism 651 comprises a rotatable shaft 651*a* and a plurality of projection 651*b* each opposed to the short portion 650*b* of the jack 650.

While the key is staying in the rest position, the long portion 650*a* is held in contact with a hammer roller (not shown). The short portion 650*b* has a curved surface 650*c* having the same radius of curvature as a trajectory of the leading end of the projection 651*b* during a rotation of the regulating button mechanism 651.

Though not shown in FIG. 17, a driving mechanism is connected to the rotatable shaft 651*a*, and changes a contact point between the curved surface 650*c* and the associated projection 651*b*.

While the key is being downwardly moved by a player, the short portion 651*b* is moved toward the projection 651*b*, and the projection 651*b* is brought into contact with the curved surface 650*c* at the same timing regardless of the angular position of the projection 651*b*. The hammer velocity is variable depending upon the contact point between the short portion 650*b* and the projection 651*b*, and the timbre and the loudness of the acoustic tones are arbitrary changed by the player.

Sixth Embodiment

Figure 18:
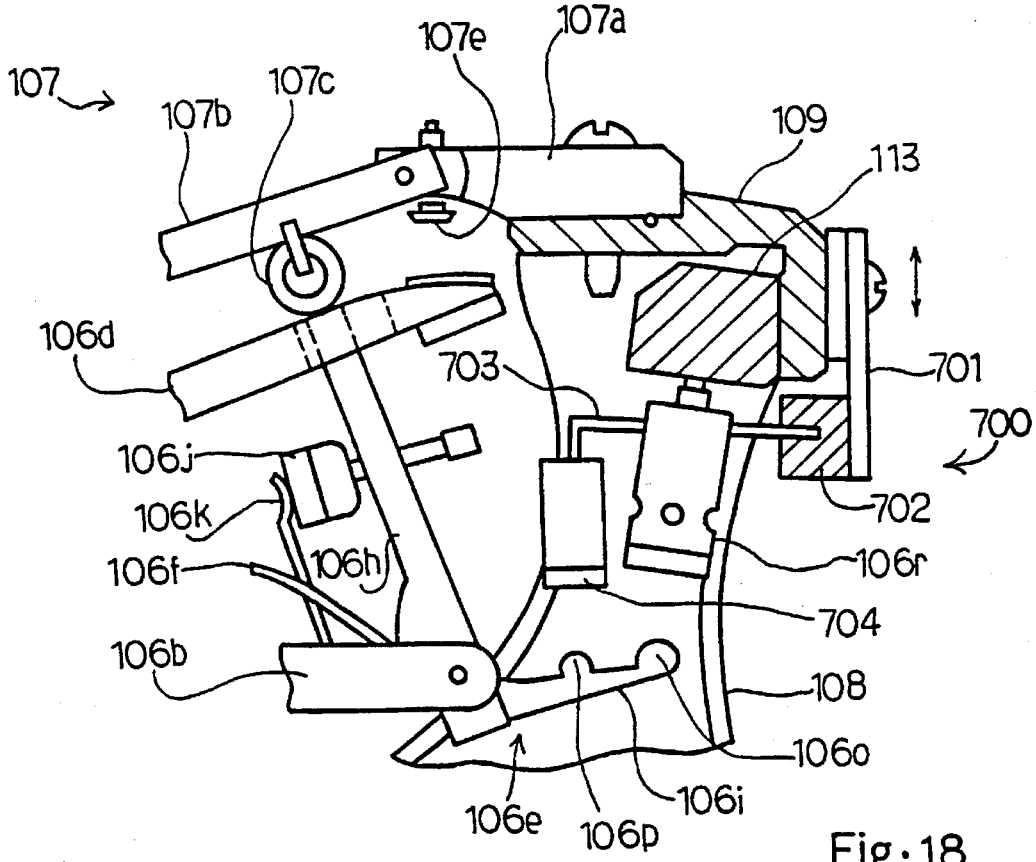
FIG. 18 is a side view showing a regulating button mechanism incorporated in another keyboard musical instrument according to the present invention.

FIGS. 18 illustrates a key action mechanism incorporated in a keyboard musical instrument embodying the present invention. The keyboard musical instrument implementing the sixth embodiment is similar to the first embodiment except for a regulating button mechanism 700, and, for this reason, the component parts of the sixth embodiment are labeled with the same references designating corresponding parts of the first embodiment without detailed description.

The regulating button mechanism 700 comprises a first regulating rail 113, a plurality of first regulating buttons 106*r*, a slidable plate 701 slidable with respect to the shank rail 109, a second regulating rail 702 connected to the slidable plate 701, a plurality of arm members 703 rearwardly projecting from the second regulating rail 702 and a plurality of second regulating buttons 704 supported by the arm members 703, respectively. The first regulating buttons 106*r* and the second regulating buttons 704 are respectively opposed to the first semi-spherical portions 106*o* and the second semi-spherical portions 106*p*, and one of the first regulating button 106*r* and the second regulating button 704 is brought into contact with the associated semi-spherical portion so that the jack 106*e* escapes from the hammer roller 107*c*.

Though not shown in FIG. 18, an appropriate driving mechanism is connected to the slidable plate 701, and changes the second regulating buttons 704 between the idling position and the active position.

The keyboard musical instrument implementing the sixth embodiment also selectively enters into the standard acoustic sound mode, the muting mode and the silent mode. The driving mechanism (not shown) maintains the second regulating buttons 704 in the active position in the muting and silent modes, and the jacks 106*e* escape from the hammer rollers 107*c* through the contact between the second semi-spherical portions 106*p* and the second regulating buttons 704.

On the other hand, while a player is performing a music in the standard acoustic sound mode, the driving mechanism (not shown) maintains the second regulating buttons in the idling position, and the first semi-spherical portions 106*o* are brought into contact with the first regulating buttons 106*r* so that the jacks 106*e* escape from the hammer rollers 107*c*.

The keyboard musical instrument implementing the sixth embodiment achieves all of the advantages described in conjunction with the first embodiment.

Seventh Embodiment

Figure 19:
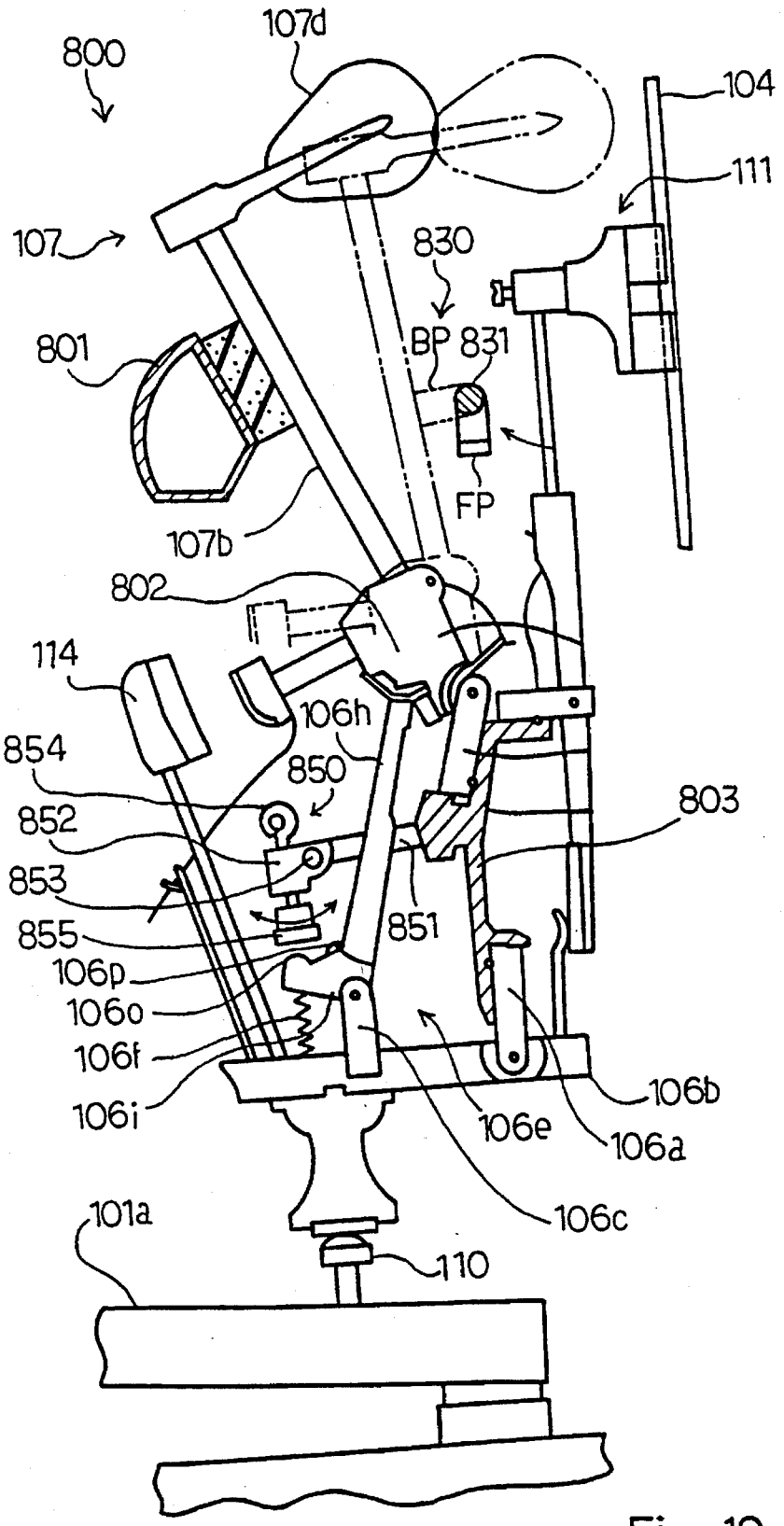
FIG. 19 is a side view showing a regulating button mechanism incorporated in a keyboard musical instrument according to the present invention.

Referring to FIG. 19 of the drawings, a keyboard musical instrument implementing the seventh embodiment largely comprises an acoustic piano 800, a silent mechanism 830 and an electronic sound generating system (not shown). The electronic sound generating system for the seventh embodiment is similar to that of the first embodiment, and no further description is incorporated hereinbelow for the sake of simplicity.

The acoustic piano 800 is a standard upright piano, and parts of the acoustic piano 800 are labeled with the same references designating corresponding parts of the grand piano 100. While the key 101*a* is staying in the rest position, the hammer assemblies 107 are resting on a hammer rail 801, and the long portion 106*h* of the jack 106*e* is held in contact with a hammer butt 802 of the hammer assembly 107. While the key is being moved from the rest position to the end position, the capstan button 110 upwardly pushes the whippen assembly 106*b*, and rotates the whippen assembly 106*b* around the whippen flange 106*a*. The short portion 106*i* is brought into contact with a regulating button mechanism 850, and the jack 106*e* escapes from the hammer butt 802.

The regulating button mechanism 850 comprises a bracket 851 supported by a center rail 803, a regulating rail 852, a rotatable shaft member 853 rotatably connected to the bracket 851, a plurality of regulating screws 854 screwed into the regulating rail 852 and a plurality of movable regulating buttons 855 supported by the regulating screws 854, respectively. Though not shown in FIG. 19, an appropriate driving mechanism is connected to the rotatable shaft member 853, and moves the regulating rail 852, the regulating screws 854 and the movable regulating buttons 855 around the rotatable shaft member 853.

The movable regulating buttons 855 are opposed to the first semi-spherical portions 106*o* in the standard acoustic sound mode and to the second semi-spherical portions 106*p* in the muting and silent modes. The function of the movable regulating buttons 855 is similar to the movable regulating buttons of the fourth embodiment, and description is omitted for the sake of simplicity.

The silent mechanism 830 comprises a shank stopper 831 changed between the free position FP and the blocking position BP, and a change-over mechanism (not shown) manipulated by a player. The behavior of the silent mechanism 830 is similar to that of the first embodiment, and description on the silent system 830 is omitted for the sake of simplicity.

The regulating button mechanism 850 is rather simple than the regulating button mechanism of the first embodiment, and the keyboard musical instrument implementing the seventh embodiment achieves all of the advantages of the first embodiment.

Although particular embodiments of the present invention have been shown and described, it will be obvious to those skilled in the art that various changes and modifications may be made without departing from the spirit and scope of the present invention.

For example, a keyboard musical instrument according to the present invention may be equipped with an automatic playing system for performing a music instead of a player, and an acoustic piano is not limited to the grand and upright types.

The shank stopper may be changed between the free position and the blocking position through a sliding motion in a longitudinal or lateral direction of the keyboard 101. In order to change the shank stopper between the free position and the blocking position through a lateral motion, cushions may be provided on a board at intervals equal to the pitch of the hammer shanks, and a driving mechanism moves the board by a half of the pitch so as to deviate the cushion members from the opposing positions to the hammer shanks.

What is claimed is:

1. A keyboard musical instrument comprising:

a plurality of keys respectively assigned notes of a scale, and selectively moved by a player;

a plurality of string means associated with said plurality of keys for generating acoustic tones having said notes, respectively;

a plurality of hammer assemblies respectively associated with said plurality of string means for striking the associated string means when said player selectively depresses said plurality of keys, a plurality of key action mechanisms functionally connected between said plurality of keys and said plurality of hammer assemblies, respectively, and each including a whippen assembly rotated by the associated key moved by said player, a regulating button mechanism, and a jack having a long portion and a short portion merged with said long portion at an intermediate portion rotatably supported by said whippen assembly and brought into contact with said regulating button mechanism for escaping from the associated hammer assembly; and a change-over means associated with said regulating button mechanism for changing a contact point between said short portion and said regulating button mechanism.

2. The keyboard musical instrument as set forth in claim 1, in which said regulating button mechanism includes a plurality of first regulating buttons each engageable with a first area of said short portion of said jack, and a plurality of second regulating buttons each engageable with a second area of said short portion different in distance to said intermediate portion from said first area, said change-over means being operative to change said second regulating buttons between an idling position and an active position, said plurality of second regulating buttons in said idling position being spaced from the short portions of said jacks when the said first regulating buttons are brought into contact with said short portions of said jacks.

3. The keyboard musical instrument as set forth in claim 2, in which each of said plurality of first regulating button is brought into contact with said first area when the associated key reaches a predetermined point on the way between a rest position and an end position during said idling position of said plurality of second regulating buttons, and each of said plurality of second regulating button is brought into contact with said second area when said associated key reaches said predetermined point during said active position of said plurality of second regulating buttons.

4. The keyboard musical instrument as set forth in claim 2, in which said plurality of second regulating buttons are supported by a rotatable shaft member driven for rotation by said change-over means.

5. The keyboard musical instrument as set forth in claim 2, in which said plurality of second regulating buttons are supported by swingable arm members connected to said change-over means.

6. The keyboard musical instrument as set forth in claim 2, in which said plurality of second regulating buttons are formed by rotatable projections covered with cushion members , and said change-over means changes said projections covered with said cushion members through an angular motion thereof.

7. The keyboard musical instrument as set forth in claim 1, in which said regulating button mechanism includes a plurality of movable regulating buttons respectively associated with said plurality of jacks, and said change-over means swings said plurality of movable regulating buttons around a rotational axis for changing said contact point with said short portion.

8. The keyboard musical instrument as set forth in claim 1, in which said regulating button mechanism includes a plurality of movable projections swung around a rotational axis by said change-over means, and said short portion of each jack includes a contact surface having a radius of curvature approximately equal to a distance between said rotational axis and a leading end of each of said plurality of movable projections.

9. The keyboard musical instrument as set forth in claim 1, in which said regulating button mechanism includes a plurality of first regulating buttons each engageable with a first area of said short portion of said jack, a plurality of second regulating buttons each engageable with a second area of said short portion different in length to said intermediate portion from said first area, and a slidable plate supporting said plurality of second regulating buttons, and said change-over means slides said slidable plate so as to change a distance between said plurality of second regulating buttons and said second area of said short portions of said jacks.

10. The keyboard musical instrument as set forth in claim 1, in which said plurality of keys, said plurality of string means, said plurality of hammer assemblies and said plurality of key action mechanisms form one of a grand piano and an upright piano.

11. The keyboard musical instrument as set forth in claim 1, further comprising a silent mechanism changed between a free position and a blocking position, said silent mechanism in said free position allowing said plurality of hammer assemblies to strike said plurality of string means, said silent mechanism in said blocking position causing said plurality of hammer assemblies to return to respective home positions without an impact on the associated string means.

12. The keyboard musical instrument as set forth in claim 11, in which further comprising an electronic sound generating system for generating electronic sounds when said silent mechanism is in said blocking position.

* * * * *